US007980646B2

(12) United States Patent
Mukaiyama

(10) Patent No.: US 7,980,646 B2
(45) Date of Patent: Jul. 19, 2011

(54) RECORDING APPARATUS AND RECORDING METHOD FOR RECORDING APPARATUS

(75) Inventor: Kiyoshi Mukaiyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 785 days.

(21) Appl. No.: 11/961,839

(22) Filed: Dec. 20, 2007

(65) Prior Publication Data

US 2008/0150225 A1 Jun. 26, 2008

(30) Foreign Application Priority Data

Dec. 22, 2006 (JP) ..... 2006-345995

(51) Int. Cl.
*B41J 2/165* (2006.01)

(52) U.S. Cl. ..... 347/14
(58) Field of Classification Search ..... 347/14
See application file for complete search history.

(56) References Cited

U.S. PATENT DOCUMENTS

2004/0174403 A1* 9/2004 Yoshida et al. ..... 347/15

FOREIGN PATENT DOCUMENTS

| | | | |
|---|---|---|---|
| JP | 10-244726 | | 9/1998 |
| JP | 10244726 A | * | 9/1998 |
| JP | 2004-034469 | | 2/2004 |

* cited by examiner

*Primary Examiner* — Laura E Martin
(74) *Attorney, Agent, or Firm* — Maschoff Gilmore & Israelsen

(57) ABSTRACT

A recording apparatus that performs a recording on a recording medium comprising: the recording operation a transport unit, a recording unit, a feed starting unit that starts feeding of the recording medium by the recording unit that has moved to a position on a moving path of the recording unit outside a recordable area, a determination unit that determines whether the moving direction of the recording unit for the last line of the first copy is toward the position where a recording operation for a plurality of copies of the same data is performed, the moving unit is controlled such that the moving direction of the recording unit for a first line of the second copy is opposite to the moving direction for a first line of the first copy when the moving direction for the last line of the first copy is determined not to be toward the predetermined position.

5 Claims, 13 Drawing Sheets

CASE WHERE LAST LINE IS PRINTED IN TRIGGER DIRECTION

CASE WHERE LAST LINE IS PRINTED IN DIRECTION OTHER THAN TRIGGER DIRECTION

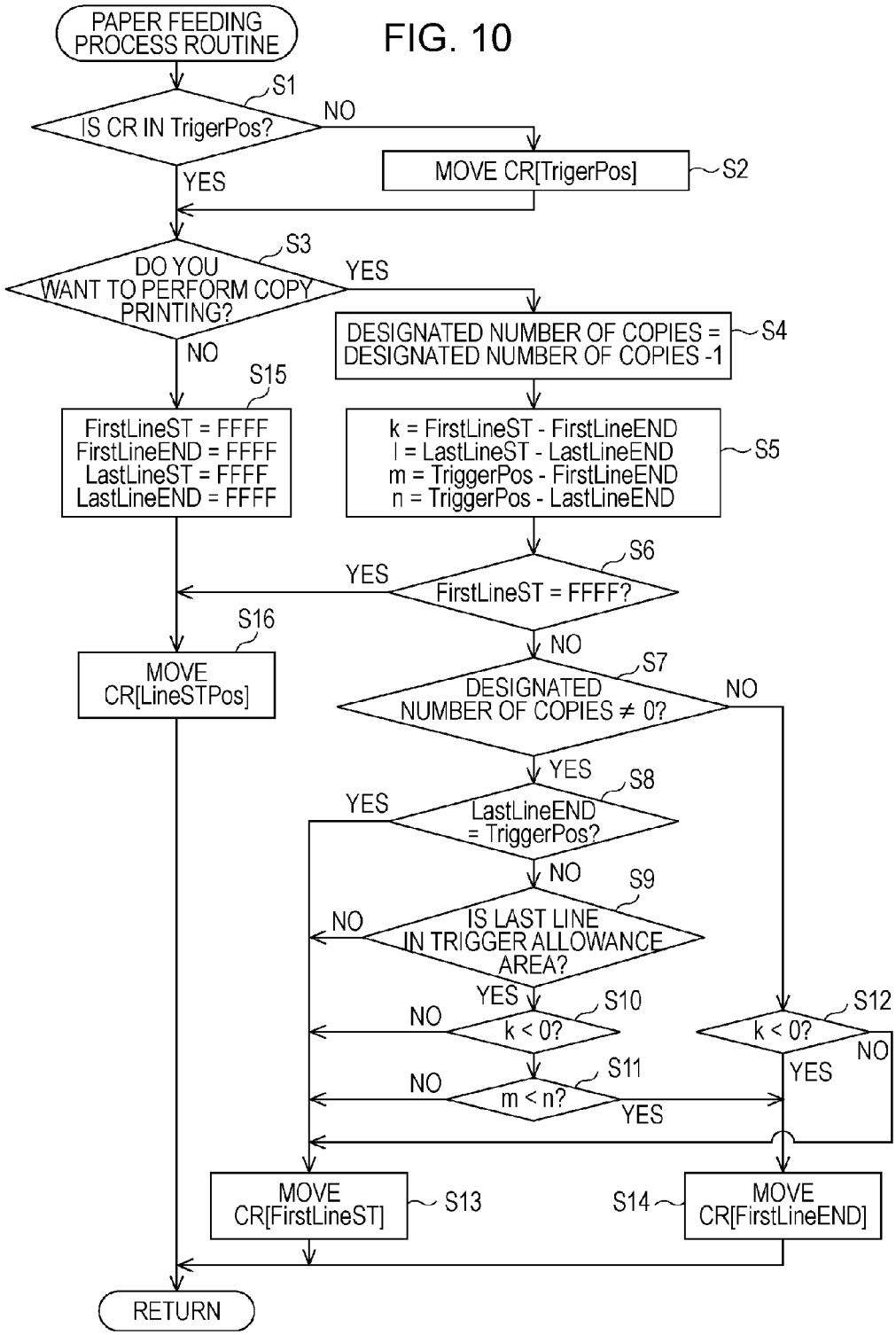
PAPER FEEDING PROCESS ROUTINE
FIG. 10
S1
IS CR IN TrigerPos?
NO
MOVE CR[TrigerPos]
S2
YES
S3
DO YOU WANT TO PERFORM COPY PRINTING?
YES
DESIGNATED NUMBER OF COPIES = DESIGNATED NUMBER OF COPIES -1
S4
NO
S15
FirstLineST = FFFF
FirstLineEND = FFFF
LastLineST = FFFF
LastLineEND = FFFF
k = FirstLineST - FirstLineEND
l = LastLineST - LastLineEND
m = TriggerPos - FirstLineEND
n = TriggerPos - LastLineEND
S5
S6
YES
FirstLineST = FFFF?
S16
MOVE CR[LineSTPos]
NO
S7
DESIGNATED NUMBER OF COPIES ≠ 0?
NO
YES
S8
YES
LastLineEND = TriggerPos?
NO
S9
NO
IS LAST LINE IN TRIGGER ALLOWANCE AREA?
YES
S10
NO
k < 0?
S12
k < 0?
NO
YES
S11
NO
m < n?
YES
MOVE CR[FirstLineST]
S13
S14
MOVE CR[FirstLineEND]
RETURN

RECORDING APPARATUS AND RECORDING METHOD FOR RECORDING APPARATUS

BACKGROUND

1. Technical Field

The present invention relates to a recording apparatus such as a serial printer in which a recording operation is processed by alternately performing transport of a recording medium and recording on the recording medium and a recording method for a recording apparatus.

2. Related Art

For example, in JP-A-10-244726, the following type of a serial printer is disclosed. The serial printer has a print starting position storage unit that stores a print starting position and a print control unit that performs a seek operation for the first line, stores the print starting position in the print starting position storage unit, and performs a printing operation for image data of the second line and thereafter on the basis of the print starting position stored in the print starting position storage unit in a case where the input print data is raster image data and one directional printing is designated. After the print starting position for the first line is stored in the print starting position storage unit, a printing head can be moved to the print starting position during a development process of the image data, without waiting for completion of the development of the image data in an image buffer. Accordingly, a time required for printing per page, for example, in a high-speed print mode can be shortened. In addition, in the high-speed print mode, printing operations are performed in both the forward and returning movements of the carriage for realizing high-speed printing.

However, in the serial printer disclosed in JP-A-10-244726, when the number of times of the carriage's movements is odd for printing one page, the printing direction for the last line is opposite to a direction toward a trigger position. In such a case, a moving distance required for the carriage, which has completed printing the last line, to move to the trigger position becomes relatively long. Accordingly, the start timing of a paper feed operation, which is started at a time when a clutch section is switched to a connection state by moving the carriage to the trigger position after completing printing the last line so as to operate a trigger lever, is relatively delayed. This type of delay of a paper feed starting timing causes a decrease in the throughput of the printing process.

SUMMARY

An advantage of some aspects of the invention is that it provides a recording apparatus and a recording method for a recording apparatus which are capable of improving the throughput by advancing the start timing for feeding a succeeding recording medium, which is performed each time a recording operation for one copy is completed, in a case where a recording operation of a plurality of copies of a same content is performed.

According to an aspect of the invention, there is provided a recording apparatus that performs a recording operation on a recording medium by alternately performing a transport operation and the recording operation. The recording apparatus includes: a transport unit that transports the recording medium; a moving unit that moves a recording unit for recording on the recording medium in a direction other than the transport direction of the recording medium; a feed unit that feeds the recording medium; a feed starting unit that starts feeding of the recording medium by using the feed unit by an operation performed by the recording unit that has moved to a predetermined position on a moving path of the recording unit outside a recordable area; a control unit that controls the transport unit and the moving unit; and a determination unit that performs a recording operation in both directions for forward and returning movements of the recording unit and determines whether the moving direction of the recording unit for recording the last line of the first copy is toward the predetermined position in a case where a recording operation for a plurality of copies of the same data is performed. The control unit controls the moving unit such that the moving direction of the recording unit for recording a first line of the second copy or one of the following copies is opposite to the moving direction of the recording unit for recording a first line of the first copy when the moving direction of the recording unit for recording the last line of the first copy is determined not to be toward the predetermined position.

BRIEF DESCRIPTION OF THE DRAWINGS

The invention will be described with reference to the accompanying drawings, wherein like numbers reference like elements.

FIG. 10 is a flowchart showing a paper feed processing routine according to an embodiment of the invention.

DESCRIPTION OF EXEMPLARY EMBODIMENTS

Figure 1:
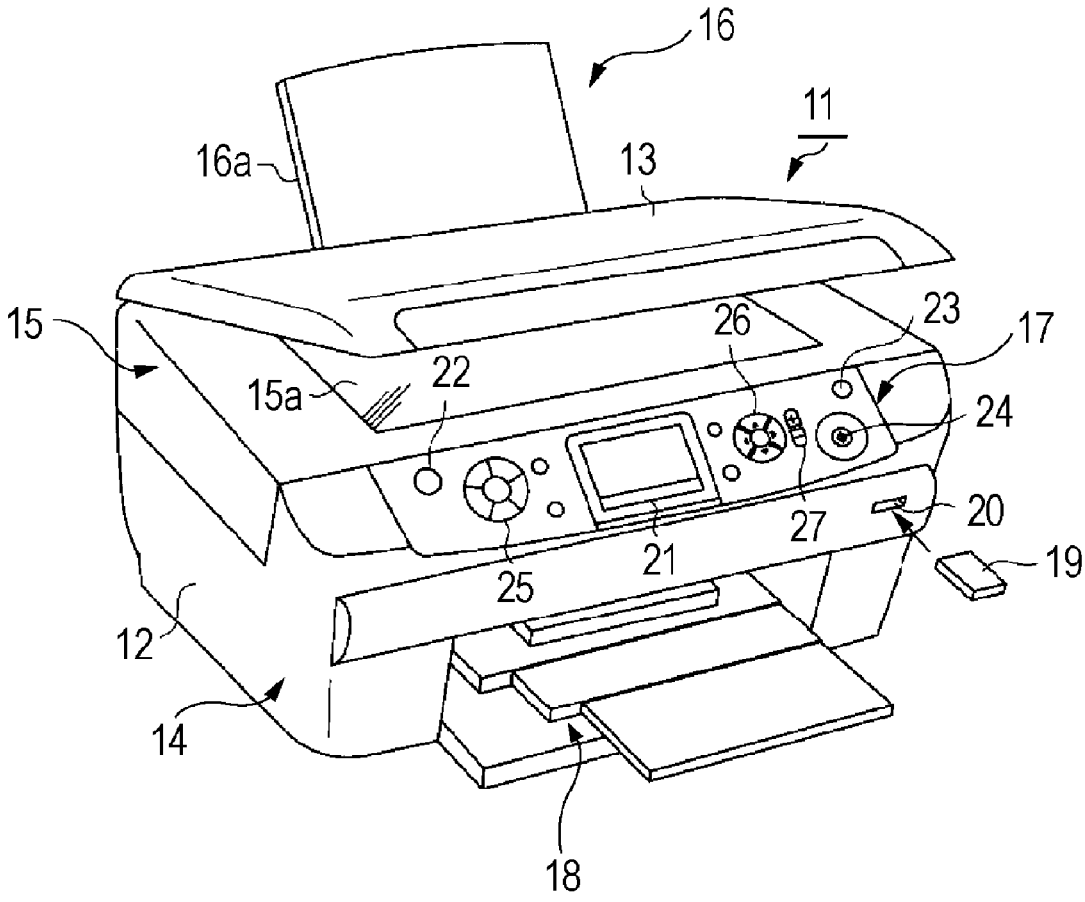
FIG. 1 is a perspective view of a multi function device according to an embodiment of the invention.

Hereinafter, an embodiment of the present invention will be described with reference to FIGS. 1 to 13. FIG. 1 is a perspective view of a multi function device that is a printer having a scanner function. The multi function device 11 includes a main body 12 and a cover 13. For example, a lower part of the main body 12 is configured to be an ink jet printer unit 14, and an upper part of the main body 12 is configured to be a scanner unit 15. On the upper side of the main body 12 in a state that the cover 13 is opened, a document mount 15*a* in which rectangular plate-shaped transparent glass is built is disposed. On the rear side of the main body 12, an auto sheet feeder (ASF) 16 having a support 16*a* in which paper is set is installed. On the front side of the main body 12, an operation panel 17 is disposed on the upper part, a discharge section 18 is disposed on the lower part, and a memory card slot (hereinafter, simply referred to as a "slot 20") into which a memory card 19 can be inserted is disposed on the right side in the middle part.

In the center of the operation panel 17 in the width direction, a monitor 21 (liquid crystal display) is disposed. On the operation panel 17, a power button 22, a stop button 23 for stopping an operation in progress, a start button 24 for starting a printing/scanning operation, and a mode selection button 25 for selecting a mode of the multi function device 11 is disposed.

The mode selection button 25 can select one mode from among a plurality of modes, for example, "copy", "scan", "memory card", and the like. On the monitor 21, a menu screen corresponding to the selected mode is displayed, and various settings for each mode or a direction for starting a printing or scanning operation can be made on a lower level screen that is switched to by selecting an item on the menu screen. Here, "copy" and "scan" are modes used for copy and scanning operations, and "memory card" is a mode used for printing a photograph or the like on the basis of image data read out from the memory card 19 inserted into the slot 20. In addition, on the operation panel 17, a selection button 26 having four arrow keys of up/down/left/right and having an OK button in the center, a number of prints button 27 for setting the number of prints, and the like are disposed.

Figure 2:
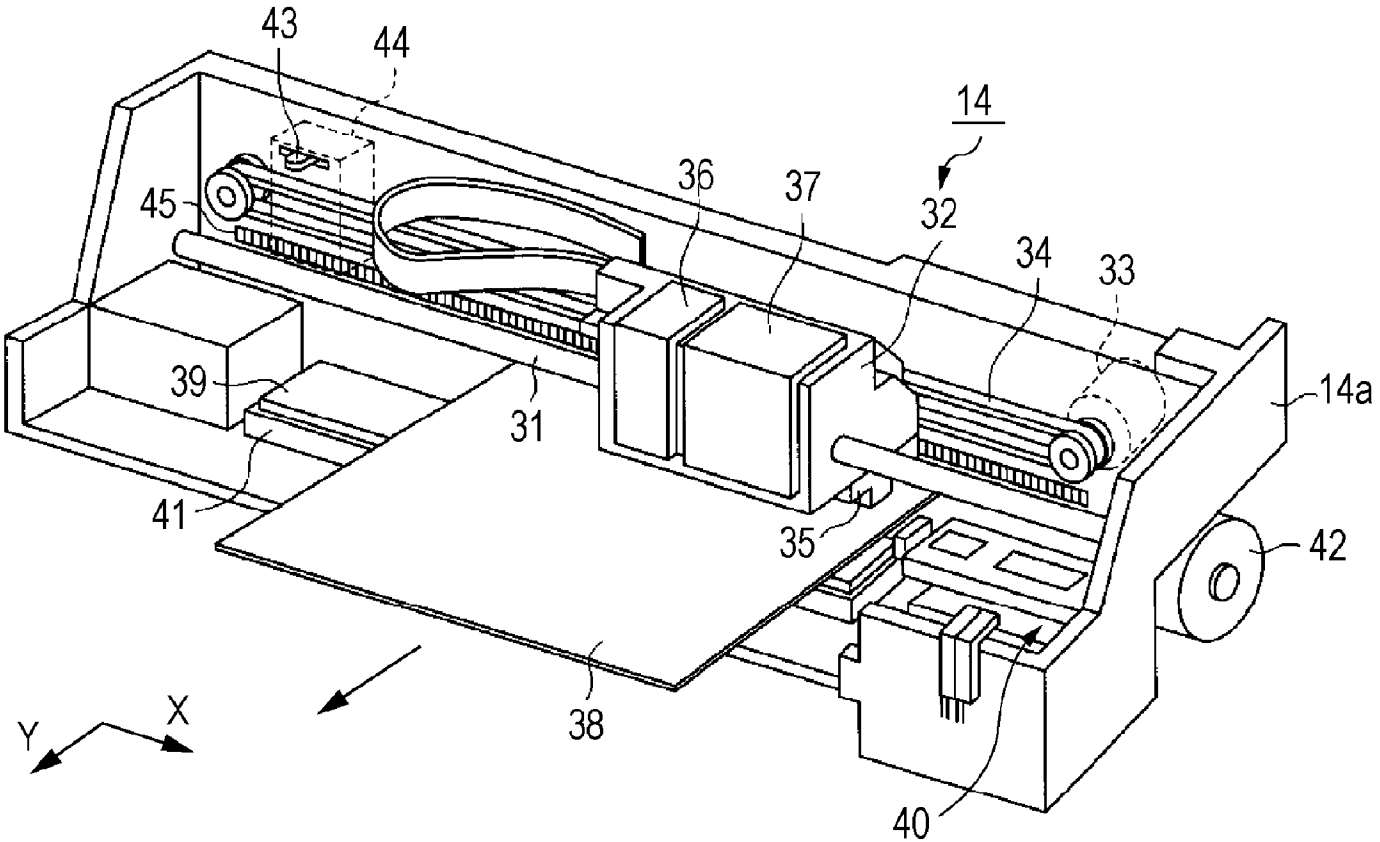
FIG. 2 is a perspective view showing a printer unit according to an embodiment of the invention.

FIG. 2 is a schematic perspective view of a printer part of a multi function device according to this embodiment. The figure shows a state that an exterior case of the multi function device is taken away. As shown in FIG. 2, the printer unit 14 has a main body case 14*a* inside the external case (not shown). In the main body case 14*a*, a carriage 32 that can reciprocate in a main scanning direction (direction X in the figure) guided by a guide shaft 31 is provided. The carriage 32 is fixed to a portion of an endless-shaped timing belt 34 that is driven to be rotated by driving a carriage motor (hereinafter, referred to as a CR motor 33). The carriage 32 is configured to reciprocate in the main scanning direction X by driving the CR motor 33 forwardly or backwardly. In this embodiment, although a DC motor is used as the CR motor 33, a stepping motor can be used.

Under the carriage 32, an ink jet type recording head 35 is disposed. To the upper side of the carriage 32, a black ink cartridge 36 and a color ink cartridge 37 for supplying ink to the recording head 35 are detachably attached. The bottom surface of the recording head 35 is formed as a nozzle forming surface in which a plurality of nozzles is formed for each ink color.

The recording head 35 includes one piezoelectric vibrator (not shown) for each nozzle. A piezoelectric vibrator corresponding to a nozzle for ejecting ink droplets is vibrated in accordance with an electrostrictive effect on the basis of the application of a pulse voltage, and ink chambers arranged for each nozzle inside the recording head 35 are expanded and compressed, and thereby ink droplets are ejected (discharged) from each nozzle. In this embodiment, a recording unit is constituted by the recording head 35 and the carriage 32. In addition, a moving unit for moving the recording unit is constituted by the guide shaft 31, the timing belt 34, the CR motor 33, and the like.

On the lower side of the carriage 32, a platen 39 having, for example, a flat shape, which regulates a distance (gap) between the recording head 35 and paper 38 is disposed in a state that the longitudinal direction thereof coincides with the axis direction of the guide shaft 31. The right end position in FIG. 2 located outside the recordable area in which a recording (ink droplet ejecting) operation can be performed in the moving range of the carriage 32 in the main scanning direction of the carriage 32 in FIG. 2 is configured to be a home position of the carriage 32. In the position corresponding to the home position, a maintenance section 40 that performs a cleaning operation for the recording head 35 and the like is disposed. In addition, on the lower side of the platen 39, a waste liquid tank 41 for storing a waste liquid discharged from the maintenance section 40 is disposed.

In the lower right end of the main body case 14*a* in FIG. 1, a paper feed motor (hereinafter, referred to as a PF motor 42) is disposed. In the left end position in FIG. 2 located outside a side opposite the home position relative to the recordable area in the moving range of the carriage 32 in the main scanning direction, a trigger lever 43 protrudes from an opening portion of a rear wall of the main body case 14*a* to be disposed in a position for being engaged with the carriage 32. The trigger lever 43 is configured to be operated so as to switch a clutch section 44 that can be switched to a connection state in which the driving force of the PF motor 42 can be transferred to a paper feed roller 48 (see FIG. 3) or a disconnection state in which the driving force cannot be transferred. In other words, when the carriage 32 moves to a trigger position (predetermined position) on a side opposite the home position and presses the trigger lever 43, the clutch section 44 is switched to a connection state in which the driving force of the PF motor 42 can be transferred to the paper feed roller 48. The clutch section 44 is configured to be interposed between the rotation shaft of a transport roller (transport drive roller) which is described later and interlocked with an output shaft of the PF motor 42 and the rotation shaft of the paper feed roller 48.

By driving the PF motor 42 in the forward rotation direction in a state that the carriage 32 is moved to the trigger position and the clutch section 44 is switched to a connection state, the paper feed roller 48 (see FIG. 3) is rotated, and thereby the paper 38 is fed. When the trigger lever 43 is operated once and the clutch section 44 is in a connection state, it is configured that the connection state of the clutch section 44 is maintained during approximate one revolution of the paper feed roller 48 even when the carriage 32 is apart from the trigger position. In addition, when the paper feed roller 48 is rotated approximately once, it is configured that the clutch section 44 is switched to a disconnection state by an urging force of a restoring spring (not shown). A configuration in which the clutch section 44 is maintained to be in a connection state only during a period in which the carriage 32 is located in the trigger position may be used. In addition, the trigger lever 43 may be disposed in a position on a same side as the home position, as long as the position is outside the recordable area of the carriage 32.

In addition, in a paper transport process after the paper feeding process, it is configured that the paper 38 is transported (paper transport) in a sub scanning direction Y in a state that the paper 38 is pinched by the transport roller 46 (see FIG. 3) driven by the PF motor 42. A printing operation (recording operation) performed by ejecting ink droplets from the recording head 35 during the movement of the carriage 32 in the main scanning direction X and a paper transport operation of the paper 38 in the sub scanning direction Y are alternately performed, and thereby a printing operation on the paper 38 is performed. In addition, in the printer unit 14, a linear encoder 45 is disposed along the guide shaft 31. The linear encoder 45 outputs pulses in proportion to the moving distance of the carriage 32 so that operations for controlling the speed and position of the carriage 32 are performed on the basis of the moving position, moving speed, and moving direction of the carriage 32 acquired by detecting the output pulses.

Figure 3:
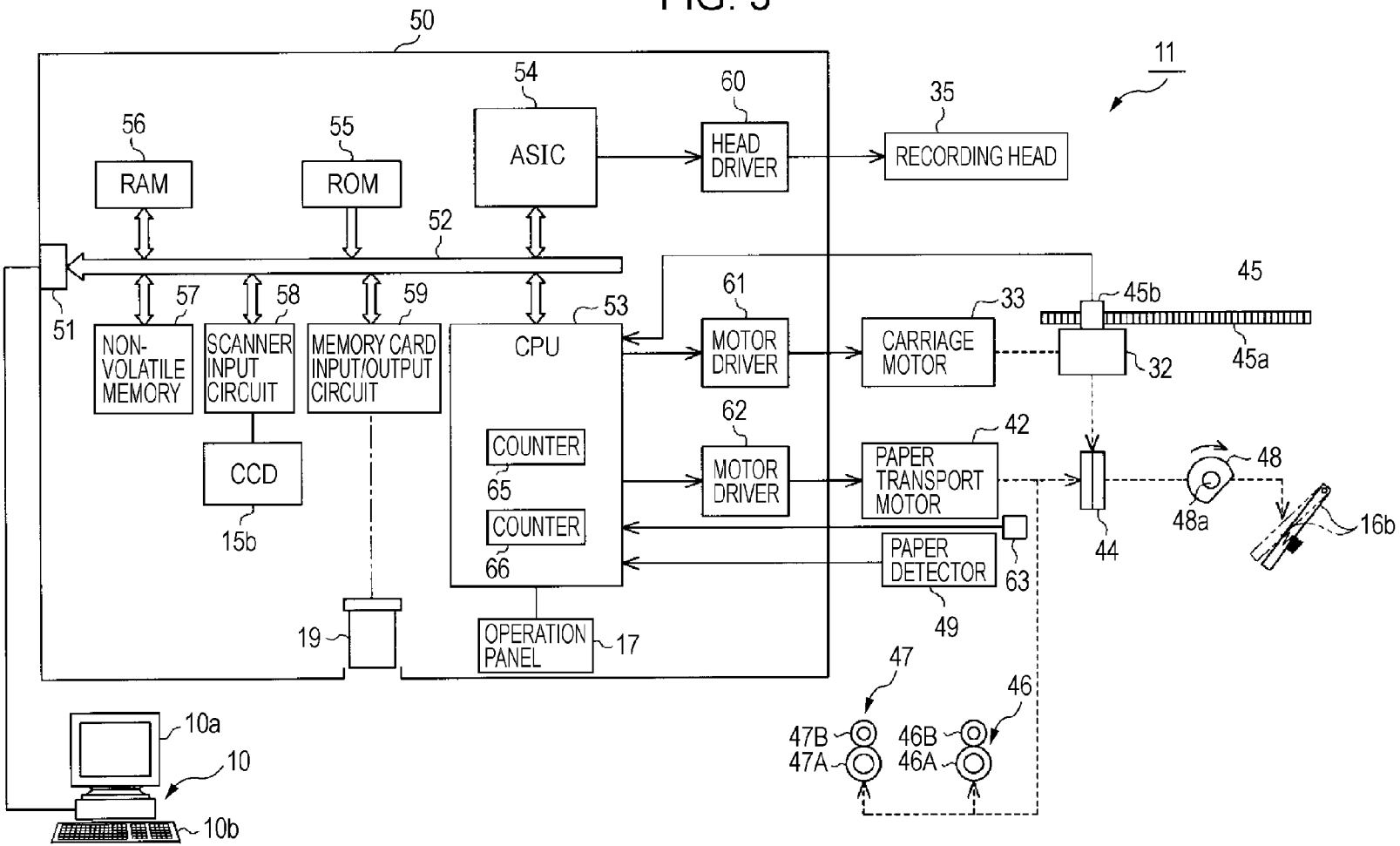
FIG. 3 is a block diagram showing the electrical configuration of the multi function device.
Figure 4:
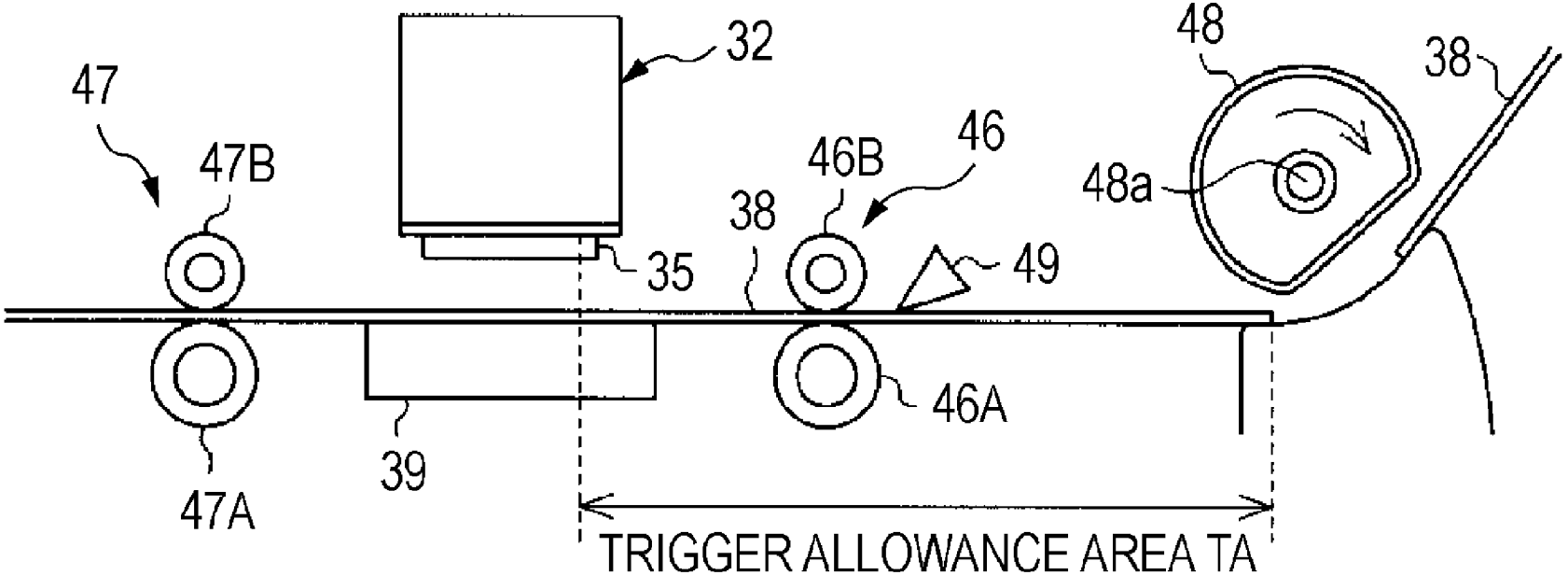
FIG. 4 is a schematic side view showing a recording head and a transport mechanism according to an embodiment of the invention.

FIG. 4 is a schematic side view showing a recording head and a transport mechanism according to an embodiment of the invention. As shown in FIG. 4, below the recording head 35, a transport roller 46 (paper transport roller) and a paper discharge roller 47 constituting a transport unit are disposed to be rotatable in positions before and after the platen 39. The transport roller 46 includes a pair of a driving roller 46A and a driven roller 46B, and the paper discharge roller 47 includes a pair of the driving roller 47A and the driven roller 47B. The paper 38 is transported in the right-to-left direction (the sub scanning direction Y) in FIG. 4 by driving both the driving rollers 46A and 47A to be rotated by using the driving force of the PF motor 42 (see FIG. 1) in a state that the paper 38 is pinched by at least one side of the both rollers 46A and 46B and the both rollers 47A and 47B. In a position located on the upper stream side of the paper transport direction relative to the transport roller 46, a paper feed roller 48 having a D-shaped side view is disposed. To the paper feed roller 48, as described above, the driving force of the PF motor 42 can be transferred by interposing the clutch section 44 that is switched to a connection state by the movement of the carriage 32 to the trigger position in the moving path. The paper feed roller 48 is configured to be in a position facing the upper side in the slope with respect to the lower end of a hopper 16*b* (see FIG. 3) and to be rotatable around the rotation shaft 48*a*. The outer circumferential surface of the paper feed roller 48 has an arc surface having a fixed distance from the shaft center and a flat surface having a distance from the shaft center shorter than the arc surface. The paper feed roller 48 is rotated from a reset position shown in FIG. 4 in the arrow direction shown in the figure to be back to the reset position for forming one revolution, by which only one sheet located uppermost from among a plurality of sheets of the paper 38 stacked on the hopper 16*b* is fed.

In addition, in a position located slightly on the upper stream side of the paper transport direction from the transport roller 46, a paper detector 49 is disposed. The paper detector 49, for example, includes a non-contact type sensor (switch type sensor) and is disposed in a state that a contacting detection lever can interfere with the paper 38 located on the transport path. The paper detector 49 is configured to be turned on by a front end of the fed paper 38 is brought into contact with the detection lever so as to displace the detection lever and is turned off at a time when the rear end of the paper 38 passes through the detection lever and the detection lever is restored to its original position (waiting position). However, the paper detector 49 may use a sensor of a different type as long as the sensor can detect the paper 38. Furthermore, the paper detector 49 may use an optical sensor (photo sensor) that can detect the paper 38 by receiving the reflected light of the light emitted on the paper 38.

Even when succeeding paper 38 is started to be fed, if the rear end of the preceding paper 38 passes through a set position without superposed transportation of both paper 38, the paper 38 comes into a trigger allowance area in which start of paper feed by moving the carriage 32 to the trigger position is allowed. When the feed operation for the paper is started in a state that the paper 38 is located in the trigger allowance area, superposed transport in which the rear end of the preceding paper 38 and the front end of the succeeding paper 38 are transported with being overlapped can be prevented. In addition, the position of the paper 38 is configured to be managed in a position on the paper 38 corresponding to the position of the uppermost nozzle from among nozzle arrays in which a plurality of nozzles (for example, 180) are formed on the lower side of the recording head 35 with a constant pitch in the transport direction (left-to-right direction in FIG. 4). The position of the paper 38 shown in FIG. 4 is the position on the uppermost stream of paper that can be started to be fed.

Next, the electrical configuration of the multi function device will be described with reference to FIG. 3. As shown in FIG. 3, the multi function device 11 has a control unit 50 responsible for various control operations. The control unit 50 includes an interface 51 that is communicably connected a host computer 10 (PC). To a bus 52 connected to the interface 51, a CPU 53, an ASIC 54 (Application Specific IC), a ROM 55, a RAM 56, a non-volatile memory 57, a scanner input circuit 58, a memory card input/output circuit 59, and the like are connected. The CPU 53 performs a paper feed control operation, a paper transport control operation, a printing control operation, and the like by executing a program stored in the ROM 55. The ASIC 54 performs an image process converting input print data into bitmap data having predetermined gray scale levels which becomes an ejection signal for ejecting ink droplets from the nozzles of the recording head 35.

To the ASIC 54, a head driver 60 is connected. The ASIC 54 ejects ink droplets from the nozzles by controlling the recording head 35 through the head driver 60. In addition, to the CPU 53, motor drivers 61 and 62 are connected. The CPU 53 controls driving of the CR motor 33 through the motor driver 61 and controls the driving of the PF motor 42 through the motor driver 62. The motor driver 62, the PF motor 42, the paper feed roller 48, the transport roller 46, the paper discharge roller 47, and the like constitute a transport unit. In the header of print data, various commands are attached. The CPU 53 acquires the paper transporting amount for transporting the fed paper by interpreting the commands.

The output shaft of the PF motor 42 is connected to a transport driving roller 46A and a paper discharge roller 47A through a gear train (not shown) so as to transfer power. In addition, the output shaft of the clutch section 44 which, for example, uses an end portion of the rotation shaft of the transport driving roller 46A as an input shaft is connected to the rotation shaft 48*a* of the paper feed roller 48. The clutch section 44 is in a mechanically connected state as the carriage 32 moves to the trigger position so as to push the trigger lever 43. In the end portion of a rotation shaft of the transport driving roller 46A or the gear train, a rotary encoder 63 including an disc-type encoding plate rotating together with the rotation shaft and a sensor for detecting light passing through a slit of the encoding plate is disposed.

When the clutch section 44 is in a connection state, the rotation of the PF motor 42 can be transferred to the paper feed roller 48. The rotation shaft 48*a* of the paper feed roller 48 is connected to the hopper 16*b* through a cam mechanism not shown in the figure.

The CPU 53 internally includes a counter 65 for receiving pulses output from the rotary encoder 63 and counting the number of the pulses and a counter 66 for counting the number of pulses output from the linear encoder 45. The counter 65 is reset by the CPU 53 when the paper detector 49 is turned on. Accordingly, by the counter 65, a measured value K corresponding to a distance from a detection position of the paper detector 49 in the paper transporting path to the front end of the paper 38 is counted. The CPU 53 acquires the position (transport position) of the paper 38 after the front end position adjustment from the measured value K of the counter 65. When the PF motor 42 is configured by a stepping motor, the rotary encoder 63 is removed, and the counter 65 counts the number of steps of control pulses of the PF motor 42. The CPU 53 manages the position and paper transport amount of the paper 38 on the basis of the measured number of the counter 65. In addition, the CPU 53 acquires the position of the carriage 32 from the measured number of the counter 66. From the linear encoder 45, two types of pulses having phases A and B which have a phase difference of 90 degrees, and the CPU 53 acquires the moving direction of the carriage 32 on the basis of a phase delay difference between the phases A and B. For example, when the phase A leads the phase B by 90 degrees, it is determined that the carriage 32 moves in a direction away from the home position. On the other hand, when the phase A lags the phase B by 90 degrees, it is determined that the carriage 32 moves in a direction approaching the home position. In addition, the CPU 53 acquires the speed of the carriage by measuring the pulse period of output pulses of the linear encoder 45.

Figure 11:
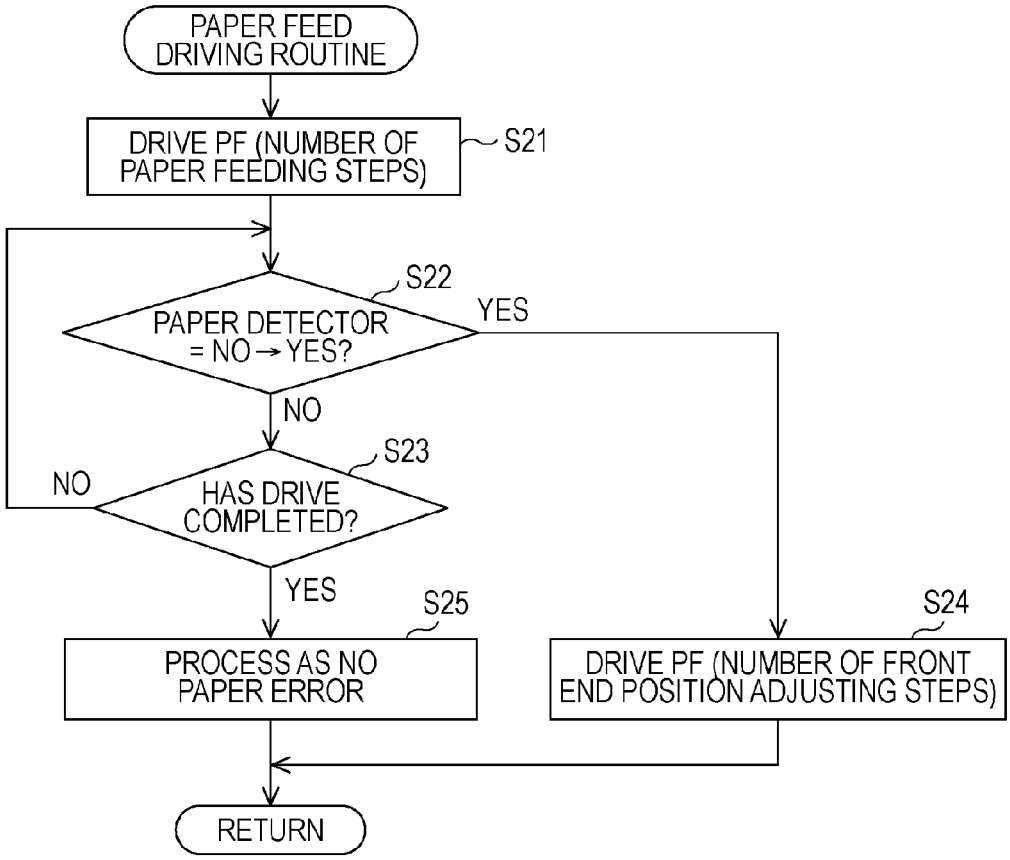
FIG. 11 is a flowchart showing a paper feed driving routine according to an embodiment of the invention.
Figure 12:
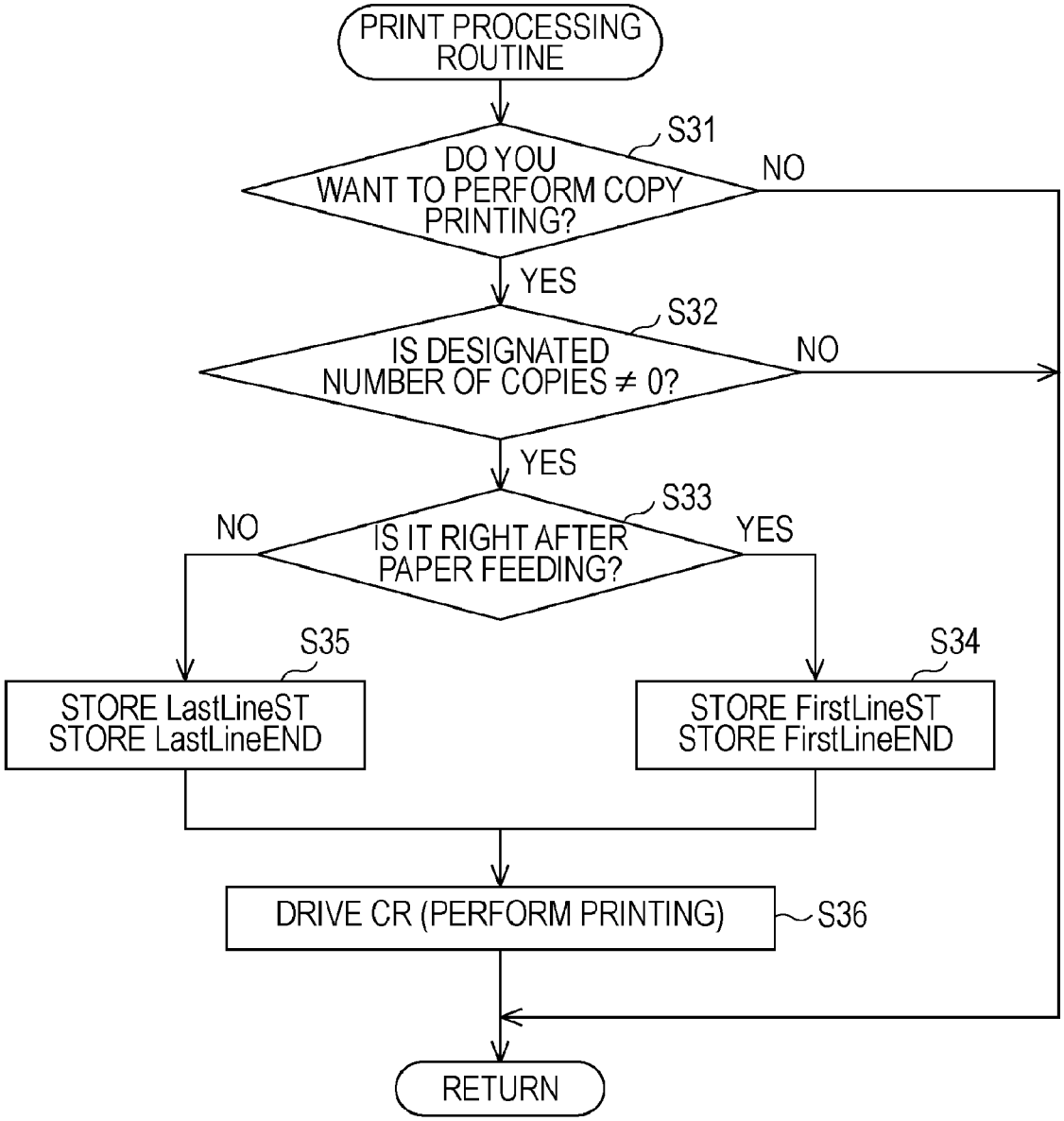
FIG. 12 is a flowchart showing a print processing routine according to an embodiment of the invention.
Figure 13:
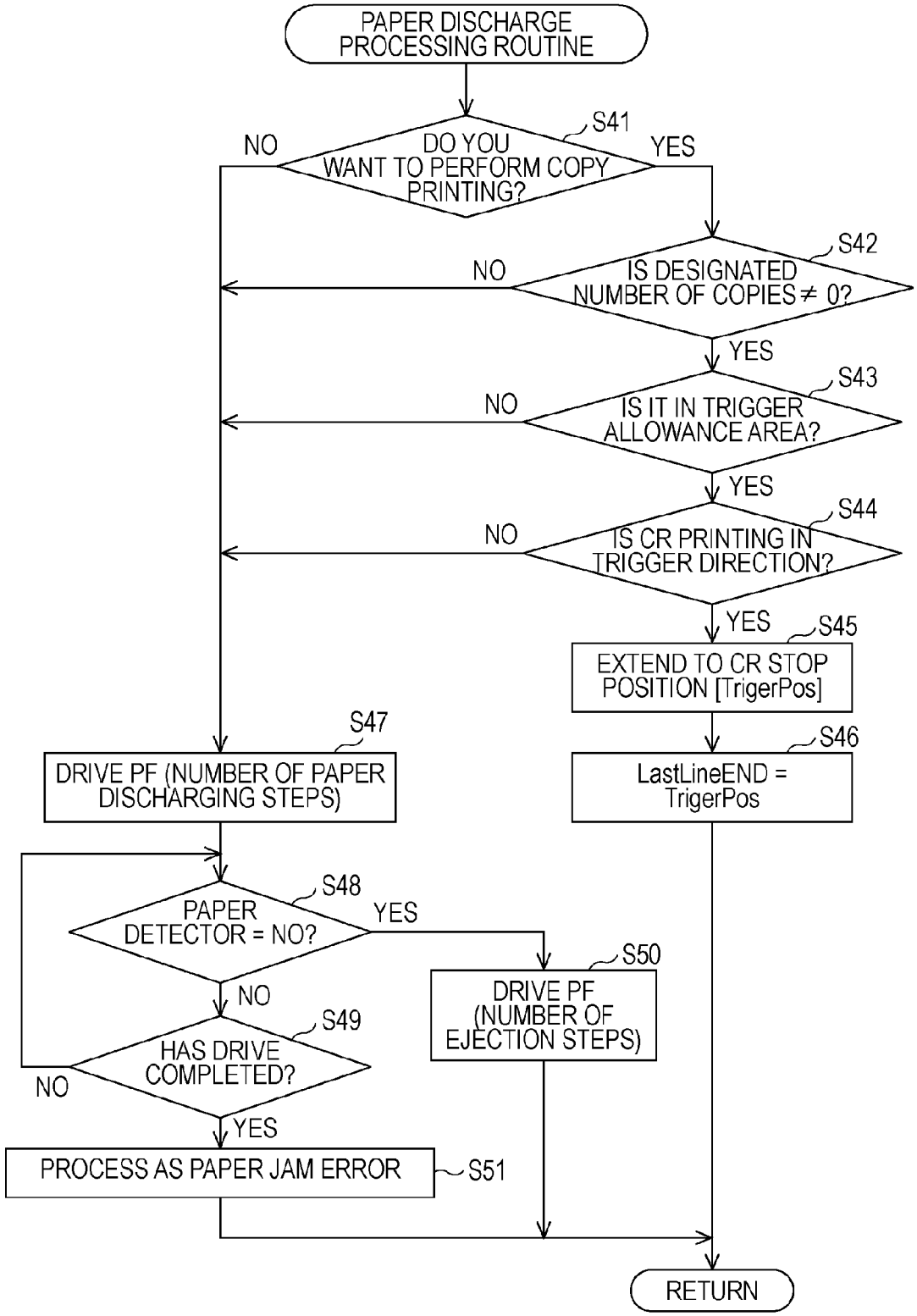
FIG. 13 is a flowchart showing a paper discharge processing routine according to an embodiment of the invention.

In the ROM 55, program data for a paper feed processing routine shown in a flowchart of FIG. 10, a paper feed driving routing shown in FIG. 11, a print processing routine shown in a flowchart of FIG. 12, and a paper discharge processing routine shown in FIG. 13 is stored. The CPU 53 performs a paper feeding operation, a printing operation, a paper transporting operation, and a paper discharging operations by executing the programs. In addition, to the CPU 53, an operation panel 17 is connected. In particular, a monitor 21 on the operation panel 17 is connected to the CPU 53 through a display driver (not shown). When an operation button on the operation panel 17 is operated, the CPU 53 performs a predetermined process such as a scan process, a copy process, a printing process, a menu display process on the monitor 21, or a display process for reflecting the result of selection on the menu screen, on the basis of the input operation.

The memory card input/output circuit 59 serves as an interface circuit of the memory card 19 inserted into the slot 20. In the memory card 19, an image file, for example, in a JPEG format which is photographed by a digital camera not shown in the figure is stored. In the ASIC 54, an image processing circuit is included.

The scanner unit 15 optically reads out a document placed in the document mount (not shown) below the cover 13, performs A/D conversion for charges accumulated in a CCD 15*b*(charge coupled device) by using an A/D converter circuit, and outputs the converted data to the scanner input circuit 58. After storing raster line data (multi gray-scale level image data of RGB) input from the scanner unit 15 in a buffer, the scanner input circuit 58 performs an interline correction process of the RGB data and a print resolution converting process that converts the read resolution of the RGB data into a print resolution used by the printer unit 14 for printing, under the control of the CPU 53. In addition, the image processing circuit acquires the image data for which the resolution conversion process has been performed and performs known image processes such as a color conversion process, a half-tone process, and a Micro Weave process for the acquired image data. Then, head driving data (print data) is generated on the basis of the image data for which the Micro Weave process has been performed. The head driver 60 drives the recording head 35 on the basis of the head driving data under the control of the CPU 53 for determining ejection of ink droplets or controlling the amount of the ink droplets.

In the ROM 55, programs are recorded. The CPU 53 performs various processes and control processes by executing programs read out from the ROM 55.

Figure 5:
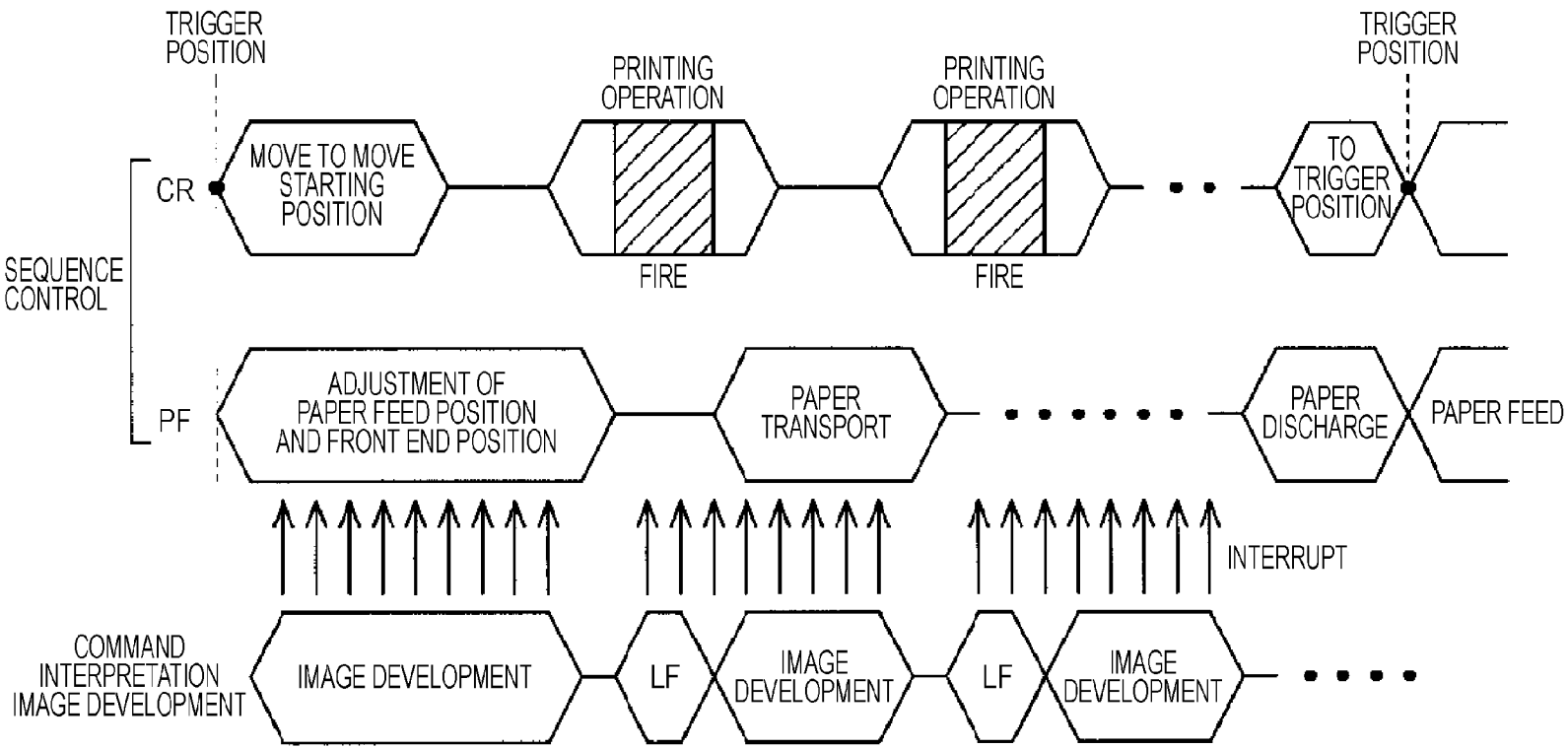
FIG. 5 is a timing chart showing a process of a CPU according to an embodiment of the invention.

FIG. 5 shows a timing chart of various processes performed by the CPU 53 during a printing operation.

When receiving a direction for start of a printing operation is received, the CPU 53 performs a sequence control (mechanical control) process for controlling the driving of the CR motor 33 and the PF motor 42 as an interrupt process while performing a command interpretation process and an image development process. In the sequence control process, there are a "paper feed" sequence, a "printing (movement of the carriage and ejection of ink droplets)" sequence, a "paper transport" sequence, a "paper discharge" sequence, and the like. In particular, each sequence controls at least one between the CR motor 33 and the PF motor 42. The paper feed sequence is started as the carriage 32 is moved to the trigger position and the clutch section 44 is switched to a connection state. In the paper feed sequence, the carriage 32 is moved to the move starting position by controlling the CR motor 33 together with performing paper feeding and front end position adjustment of the paper 38 by controlling the PF motor 42. In the printing sequence, the carriage 32 is sequentially moved by one pass distance by controlling the CR motor 33, and when the carriage 32 reaches the print starting position (record starting position) during the movement, ink droplet ejecting (firing) is started by using the recording head 35 for performing a printing operation. The paper discharge sequence is started by a discharge command. However, when there is a succeeding page to be printed and the position of the paper 38 is inside the trigger allowance area, the paper discharge sequence is omitted, and the control proceeds to the paper feed sequence immediately. In such a case, the preceding paper for which the printing operation has been completed is discharged by rotation of the paper discharge roller 47 performed together with the paper feeding operation of the succeeding paper.

In this embodiment, the move starting time of the carriage 32 is controlled such that an ink ejection (firing) operation is started almost simultaneously with completion of the fed paper front end position adjustment and the paper transport operation. In particular, a time required for the carriage 32 to move from the move starting position to the print starting position is calculated, and the remaining paper transport amount requiring the time is calculated until the completion of the paper transport operation. Then, when the actual remaining paper transport amount is identical to the required remaining paper transport amount calculated in advance, the move of the carriage 32 is started. In addition, the start time of the paper transport operation is controlled such that the paper transport operation is started almost simultaneously with completion of the ink ejection (firing) operation. In other words, the paper transport operation is started on the basis of an ejection completion signal transmitted from the head driver 60. Accordingly, the printing operation and the paper transport operation are performed (overlapped) parallel in part, and the paper transport operation and the printing operation (ink ejection) are alternately performed in a repeated manner. As a result, a waiting period from completion of the paper transport operation to the start of the print operation and a waiting period from completion of the printing operation to start of the paper transport operation can be decreased to be minimal, and thereby a throughput of the printing process is improved.

In addition, after starting the paper feed sequence by receiving the direction for starting the print operation, the CPU 53 performs image development of the print data (line raster data) corresponding to the first line (first row). Since the image development is a process in which dots are rearranged to be developed in an image buffer (output buffer) for each line (line raster data) in accordance with an ink droplet ejection sequence (dot formation sequence) from the nozzles of the recording head 35, it requires a considerable processing time. Accordingly, in order to expedite the start of the paper feed operation, the paper feed sequence is started first.

Two image buffers may be provided. In such a case, the line raster data for which the development process has been performed is stored in each buffer as images one line after the other line. Thus, in the middle of the printing operation for one line on the basis of line raster data from one image buffer, a development process by using the other buffer is configured to be performed, and when the printing operation for the line is completed, a printing operation for the next line is configured to be started immediately. Since the print starting position (ejection starting position) of the first line and the print ending position (ejection ending position) thereof is determined on the basis of the result of the image development, an optimal move starting position of the carriage 32 cannot be requested during the paper feed period in which the carriage 32 can be freely moved.

Accordingly, the carriage 32 is moved and maintained to a predetermined move starting position (hereinafter, referred to as a set waiting position) which has been set in advance, so that the move of the carriage 32 can be started from the set waiting position. This set waiting position is configured to be a position moved from the end edge of the paper in the width direction toward the center side by a predetermined distance. This set waiting position, statistically in most cases, is a position that can shorten a runway interval for the carriage 32 to reach the print starting portion (a predetermined speed), and thereby a throughput can be improved. However, when the print starting position is near the end edge of the paper in the width direction, a required runway distance cannot be acquired. In such a case, the move starting position is recalculated from the print starting position by a seek process, and a seek operation for returning the carriage 32 to the calculated move starting position in the backward direction is performed, and then the move of the carriage 32 for the printing operation is started. When this seek operation is performed, there is a case where the throughput becomes lower than that by using a method in which a distance to the print starting position is sufficiently acquired. In the seek process, a position that is shifted by the number of steps corresponding to the required runway distance of the carriage 32 in a direction opposite to the moving direction is calculated as a new move starting position. In this embodiment, data generated by developing an image of line raster data for the first line corresponds to the first line data. In addition, data generated by developing line raster data for each line corresponds to the line data.

When a copy printing operation for a plurality of copies is performed, the content to be printed on the first page (first copy) and the contents to be printed on the second page (second copy) and thereafter are the same, and accordingly, the print starting positions of the first lines for each page are the same. Thus, according to this embodiment, a process in which the move starting position (FirstLineST) of the first line is stored at a time when the printing operation for the first page is performed and is used as the move starting position for the first line of the second page and thereafter is performed.

In addition, as another distinctive feature for a case where a copy printing operation for a plurality of copies is performed, when the last line (last row) of the first page is printed, if the moving direction of the carriage is not a direction toward the trigger position (that is, a direction toward the home position), a process in which the moving direction of the carriage for printing the first line of the second page and thereafter is configured to be a direction opposite to the moving direction of the carriage for printing the first line of the first page is performed.

Figure 6:
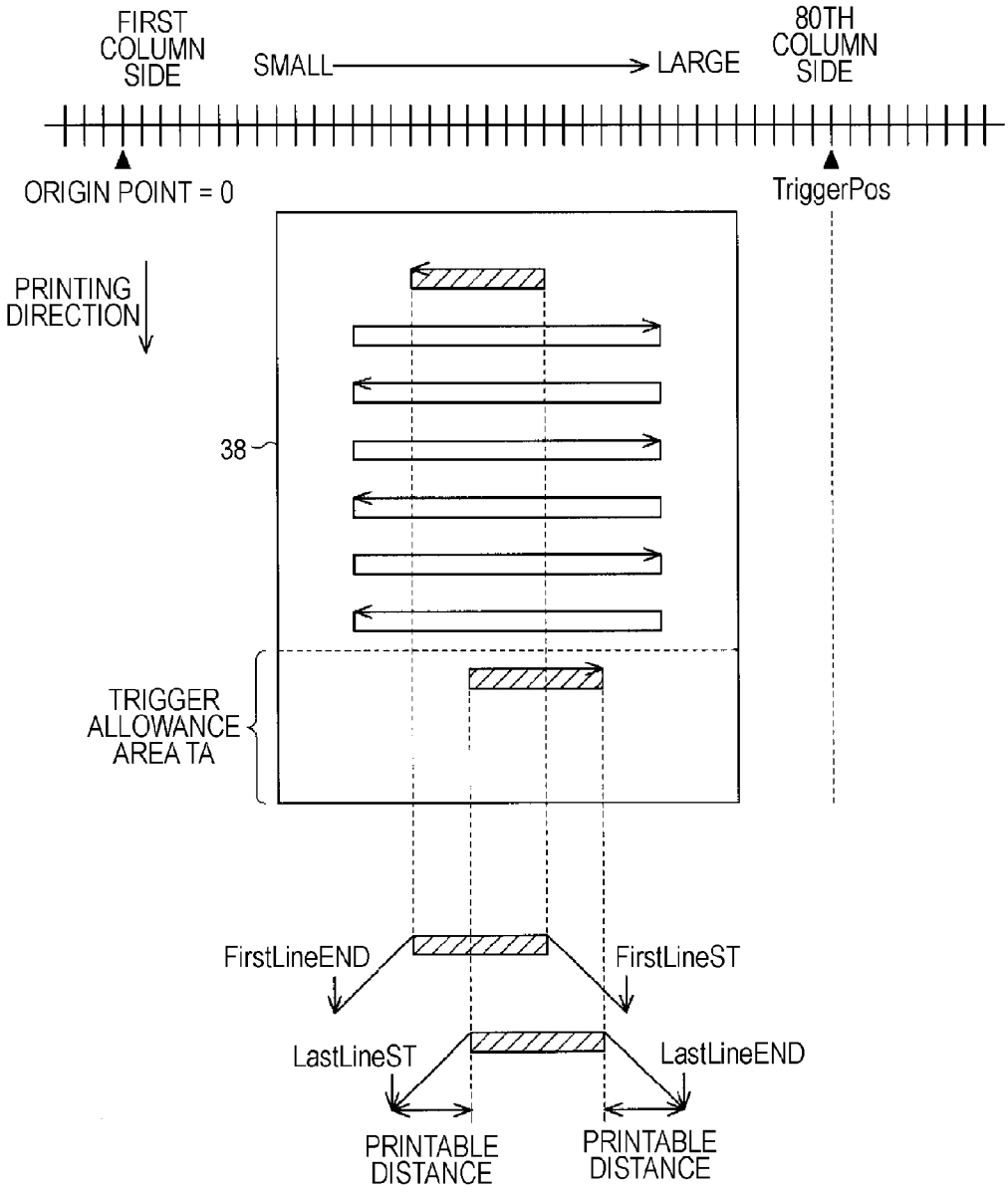
FIG. 6 is a schematic diagram showing a record process according to an embodiment of the invention.

FIG. 6 is a diagram showing a process of storing the move starting position of a first line and a process of setting the carriage moving direction for printing a first line of a next page to a direction opposite to the carriage moving direction of a first line of the first page in a case where the carriage moving direction for printing the last line is toward the home position, when a copy printing operation for a plurality of copies is performed in this embodiment. In FIG. 6, a scale drawn on the upper side of the paper indicates the carriage position in the main scanning direction. The carriage position can be acquired on the basis of the output pulses of the linear encoder 45 and corresponds to a count number of the counter 65. Of the carriage position, the origin point (=0) is set to a predetermined position (for example, the home position) on the first column side in the main scanning direction X and the trigger position Trigger Pos is set to a predetermined position on the 80th column side which has a large position value. In the example shown in FIG. 6, areas with rectangular frames inside the paper 38 are print areas in which a printing operation is performed, and the first and last lines among the print areas are hatched. Arrows attached to each print area represents the carriage moving direction. In the paper 38, a printing operation is performed from the upper side to the lower side in FIG. 6, and in a rear side (upper stream side) of the paper 38 (lower end side in FIG. 6), a trigger allowance area TA is set. As described above, in this embodiment, when a print completion line is inside the trigger allowance area TA, the paper discharging process is omitted, and the control proceeds to the paper feeding process.

Graphs drawn in the lower end of FIG. 6 represent speed profiles of the moving carriage 32 for printing the first and last lines. Here, FirstLineST is the move starting position of the first line, FirstLineEND is the stop position of the first line, LastLineST is the move starting position of the last line, and LastLineEND is the stop position of the last line. As shown in the graphs, before and after a regular speed section in which a printing operation (ink droplet ejection) is performed, runway sections (accelerating sections) that are sections from the move starting positions FirstLineST and LastLineST to the print starting positions and deceleration sections that are sections from the print ending positions to the stop positions FirstLineEND and LastLineEND are required. Here, ink droplets are required to land in the paper 38 with a fixed pitch, and thus, an ejection control process for ejecting the ink droplets at time intervals corresponding to the speed of the carriage 32 is performed. Since the carriage 32 is needed to reach a predetermined speed (a regular speed in this embodiment) required at a time point when the carriage 32 reaches a print starting position, a printable distance for reaching the predetermined speed is required to be acquired as a runway section.

The move starting position FirstLineST or LastLineST is set to be a position shifted by the distance (corresponding to a count number) of a required runway section(accelerating section) in a direction opposite to the print direction of the corresponding line from the print starting position that is a start point of a print area. As described above, the move starting positions FirstLineST and LastLineST are calculated on the basis of print starting positions. In addition, the stop positions FirstLineEND and LastLineEND are calculated on the basis of ejection ending positions acquired at a time when the stop control process is actually performed. For example, the stop position can be set to a position shifted by the distance (corresponding to a count number) of the decelerating section in the printing direction of the line from the ejection ending position. The move starting positions FirstLineST and LastLineST and the stop positions FirstLineEND and LastLineEND are stored in a predetermined area of a memory (the RAM 56 or the non-volatile memory 57). However, the relationship between the print starting position and the move starting position and the relationship between the ejection ending position and the stop position can be appropriately set. For example, the print starting position may be located in an accelerating section, or the print ending position (ejection ending position) may be located in a decelerating section.

In the example of this embodiment, a moving distance required for acceleration from the move starting position FirstLineST or LastLineST to the print starting position and a moving distance required for deceleration from the ejection ending position to the stop position FirstLineEND or LastLineEND are assumed to be the same. Accordingly, in a case where the move of the carriage 32 is started from the move starting position FirstLineST or LastLineST, or, to the contrary, in a case where the move of the carriage 32 is started from the stop position FirstLineEND or LastLineEND in the opposite direction, an operation for printing a print area of the line can be performed. When a configuration for which this assumption cannot be applied is used, a move starting position of the carriage 32 in which the original print ending position becomes the print starting position in a case where a printing operation is performed for the stop position FirstLineEND of at least the first line in the reverse direction is acquired. In other words, a position shifted by a runway distance from the original print ending position is calculated as the move starting position.

Thus, as shown in the example of FIG. 6, when a copy printing operation for a plurality of copies is performed and a printing operation for a first line of the second page or thereafter is to be performed, the carriage 32 is moved from the trigger position to the move starting position FirstLineST and waits.

Figure 7:
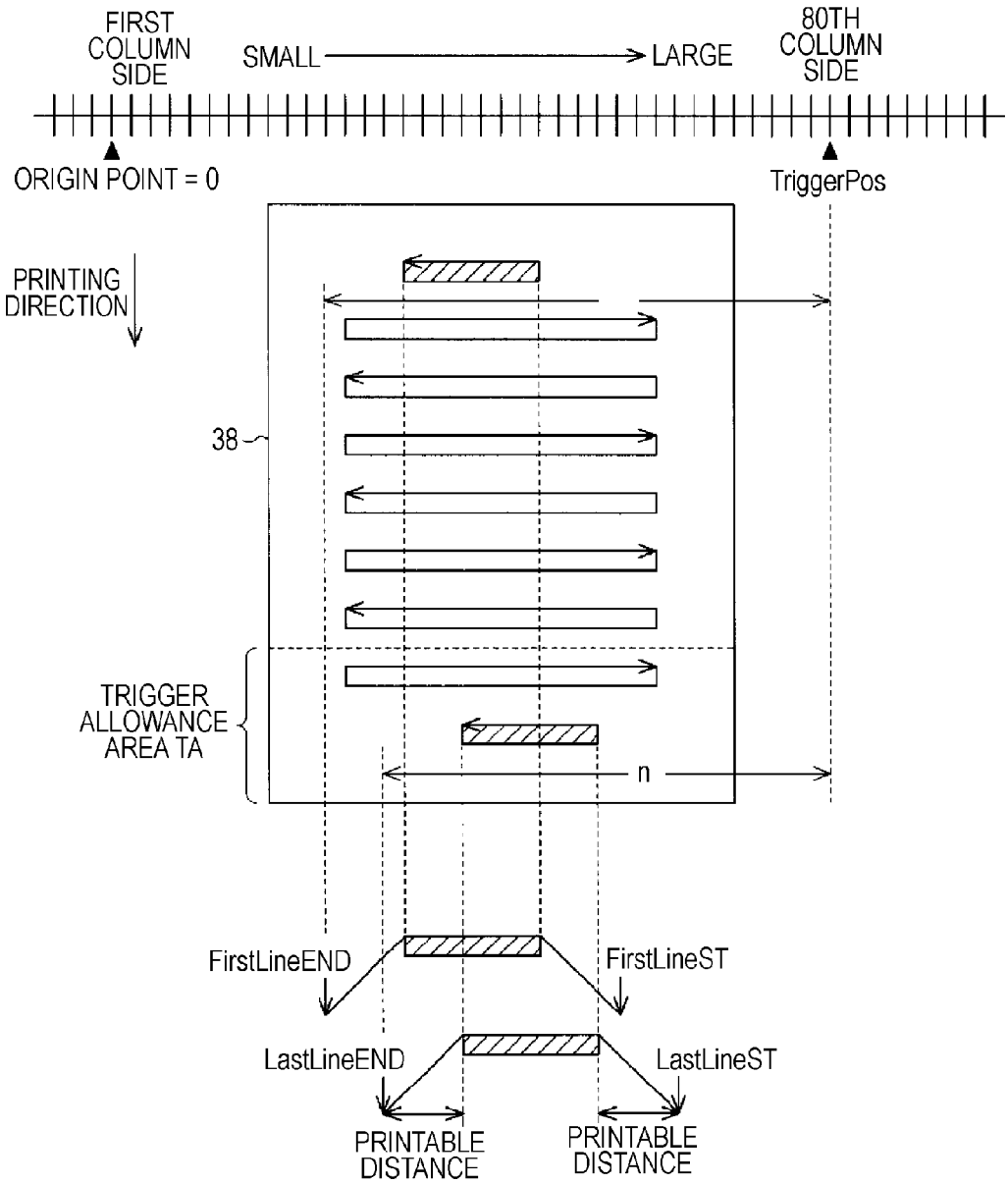
FIG. 7 is a schematic diagram showing a record process according to an embodiment of the invention.

While FIG. 6 shows an example in which the print moving direction of the last line is toward the trigger position (trigger direction), FIG. 7 shows an example in which the print moving direction of the last line is toward the origin point (counter-trigger direction). As shown in FIG. 7, when the print moving direction of the last line is toward the origin point, the print moving direction of a first line for copy printing a second page and thereafter is configured to be in a direction opposite to the print moving direction of the first line of the first page, so that the print moving direction of a last line for copy printing a second page and thereafter is toward the trigger position.

Figure 8:
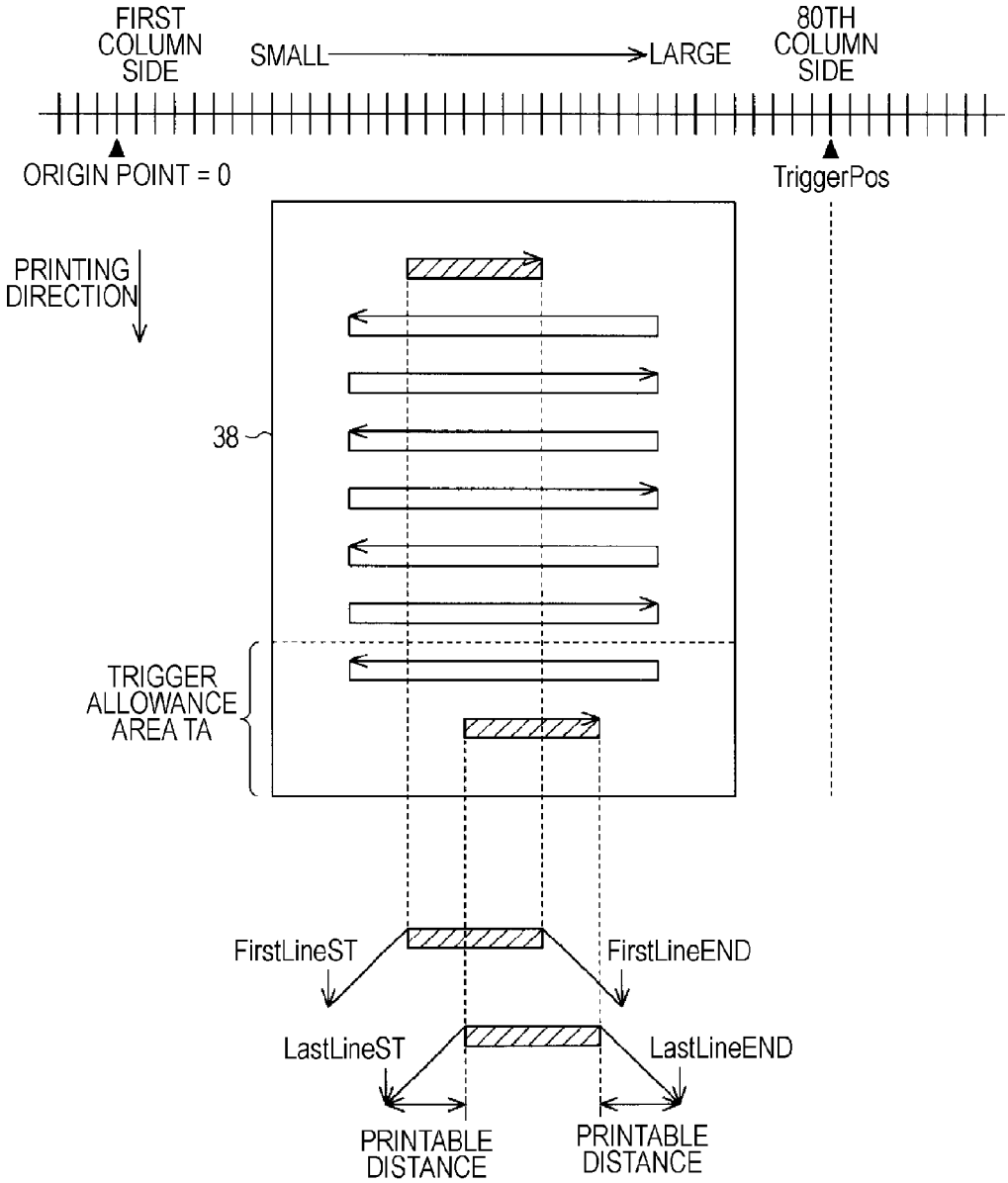
FIG. 8 is a schematic diagram showing a record process according to an embodiment of the invention.

FIG. 8 shows a copy printing process for the second page and thereafter in a case where the printing process as shown in FIG. 7 is performed for the first page. As shown in FIG. 8, the print moving direction of the first line is opposite to that of the first page, and accordingly, the print moving direction of the last line is set to be toward the trigger position. At this moment, the stop position of a first line of the first page FirstLineEND is read out from the memory and is used as the move starting position of a first line of the second page and thereafter. The above-described processes are performed by the CPU 53 executing various programs shown in flowcharts of FIGS. 10 to 13.

Hereafter, a printing process performed by the CPU 53 will be described with reference to the flowcharts shown in FIGS. 10 to 13. These programs are executed as a part of the sequence control process. FIG. 10 shows a paper feed processing routine. FIG. 11 shows a paper feed driving routine. FIG. 12 shows a print processing routine. FIG. 13 shows a paper discharge processing routine.

When a copy printing operation is performed by using the multi function device 11, a document is set by placing the document on the document mount 15*a* and closing the cover 13, a print condition for a copy mode is set by selecting "copy" by using the mode selection button 25, and then the start button 24 is pressed. When data stored in the memory card 19 inserted into the slot 20 is to be printed by using the multi function device 11, a user selects an image stored in the memory card 19 on the monitor 21 by operating the operation panel 17, sets a print condition, and presses the start button 24. At this moment, when a plurality of copies is printed, the user sets the number of prints (copies) by operating the number of prints button 27 and presses the start button 24. When a printing operation is performed from a host computer 10, the user sets a print condition by operating an input device 10*b* such as a keyboard or a mouse on a setting screen displayed on the monitor 10*a* and operates the OK button on the setting screen for performing the print operation. As a print condition, the type of paper, a paper size, color/monochrome, bidirectional printing (high-speed printing), one directional printing (high-quality printing), with/without a frame, a margin setting, the number of prints, and the like are set. When memory card printing or copy printing is performed, a print process (resolution conversion, color conversion, a half-tone process, Micro Weave, and the like) for converting data (for example, jpeg data, bmp data, or the like) of various file formats into print data is performed inside the multi function device 11. When a printing operation is requested from a host computer 10, data is converted by a printer driver (not shown) inside the host computer 10 into print data and the print data is transmitted to the multi function device 11. Hereinafter, a case where a copy printing operation is performed will be described as an example. In a state that paper is set in the auto sheet feeder 16, a document is set in the document mount 15*a*, a print condition for a plurality of copies is set, the start button 24 is pressed, then, a copy printing operation for a plurality of copies is started. First, the document is read (scanned) by the scanner unit 15, and next, printing of the read image is started. When the print is started, first, a paper feed process is started. In the paper feed process, the routines shown in FIGS. 10 and 11 are executed by the CPU 53.

First, in Step S1, it is determined whether the carriage 32 is in the trigger position TriggerPos. For example, when the carriage 32 is located in the home position and is not in the trigger position, the carriage 32 is moved to the trigger position TriggerPos (S2). In other words, the CPU 53 moves the carriage 32 to the trigger position by driving the CR motor 33 in the forward direction. As a result, the trigger lever 43 is operated, and thereby the clutch section 44 is switched to a connection state. In this state, the paper feed driving routine shown in FIG. 11 is started, the PF motor 42 is driven in the forward direction so as to perform a paper feed process for the paper 38. This paper feed driving routine will be described later.

In Step S3, it is determined whether a copy printing operation is to be performed. In other words, when a print operation is performed in a copy mode, it is determined whether a copy mode flag is "ON" ("1"). When the copy printing is to be performed, the process proceeds to Step S4. On the other hand, when the copy printing is not to be performed, the process proceeds to Step S15.

In Step S4, the designated number of copies is calculated by using an equation of "designated number of copies=designated number of copies −1". For designating the number of copies, the value of the designated number of copies (in this example, the number of prints) is used. For example, when the number of copies is N, a process for changing the number of copies into "N−1" is performed. In other words, each time when the process proceeds to a paper feed process for the next copy (next page), one is subtracted from the designated number of copies. Accordingly, when the value N of the designated number of copies becomes zero, it can be checked that the corresponding copy (page) is the final copy (final page).

In Step S5, k, l, m, n are calculated by using equations of "k=FirstLineST−FirstLineEND, "l=LastLineST−LastLineEND", "m=TriggerPos−FirstLineEND", and "n=TriggerPos−LastLineEND". Here, in these equations, FirstLineST, FirstLineEND, LastLineST, and LastLineEND are data for the move starting position of a first line, a stop position of the first line, the move starting position of a last line, and the stop position of the last line. When a copy printing operation is started, initial values of "FFFF" are set to FirstLineST, FirstLineEND, LastLineST, and LastLineEND. However, when the values are determined for actual printing, FirstLineST, FirstLineEND, LastLineST, and LastLineEND are updated to the determined values for the copy (page). Accordingly, for the second copy (second page) and thereafter, the value for the previous copy (previous page) is used.

In Step S6, it is determined whether the move starting position FirstLineST of the first line has the initial value (FirstLineST=FFFF). In other words, it is determined whether the copy printing is performed for the first time (first copy). Since the copy printing is for the first time (first copy), the process proceeds to Step S16.

In Step S16, the carriage 32 is moved to the set waiting position LineSTPos. This set waiting position is a move starting position set in advance. According to this embodiment, the set waiting position is a position in which an average moving distance to the print starting position can be effectively shortened and acquired by a rule of thumb for reducing the frequency of the carriage's returning and then starting to move by performing a seek process due to insufficient distance of the runway and start moving. Accordingly, when the runway distance is insufficient, an extra seek operation for returning the carriage 32 and starting the move is required. However, on the average, the moving distance (average value) of the carriage 32 to the print starting position can be shortened. The set waiting position LineSTPos, for example, is a position moved slightly inner side in the width direction of the paper relative to the end edge of the paper.

In this paper feed process, as the carriage 32 is moved to the trigger position TriggerPos and the clutch section 44 is switched to a connection state, the CPU 53 performs the paper feed driving routine shown in FIG. 11. As shown in FIG. 11, when the carriage 32 reaches the trigger position TriggerPos, first, the CPU 53 drives the PF motor 42 corresponding to the number of paper feed steps (Step S21). The driving of the PF motor 42 is continued until the front end of the paper 38 is detected by the paper detector 49 (by pressing the detection lever of the paper detector 49) and the paper detector 49 determines (Step S22: YES) that a "No Paper" state in which the paper detector detects no paper has been switched into a "Paper Ready" state in which paper is detected (Step S23). When the detection state of the paper detector 49 is switched from "No Paper" to "Paper Ready" (S22: YES), the PF motor 42 is driven corresponding to the number of steps for the front end position adjustment required for the front end position adjustment of the paper (Step S24). Accordingly, the front end position of the paper 38 is adjusted to a predetermined position. When the driving of the PF motor 42 corresponding to the number of paper feed steps is completed (Step S23: YES) before the state of the paper detector 49 is switched from "No Paper" to "Paper Ready", the state is processed as No Paper Error (Step S25).

Thus, when the paper feed process and the front end position adjustment for the first time (first copy) are completed, the CPU 53 starts the print processing routine shown in FIG. 12. In other words, first, in Step S31, it is determined whether a copy printing is performed. In this example, since the copy printing is performed, next in Step S32, it is determined whether the designated number of copies≠0, that is, whether the copy printing is for the final copy (final page). When the designated number of copies≠0, that is, the copy printing is not for the final copy, the process proceeds to Step S33, and it is determined whether it is right after the paper feed. When it is determined to be right after the paper feed, the process proceeds to Step S34. On the other hand, when it is determined not to be right after the paper feed, the process proceeds to Step S35.

In Step S34, the move starting position FirstLineST and the stop position FirstLineEND of the first line are stored. As shown in FIG. 5, in the paper feed front end position adjustment process, the CPU 53 performs the image development process parallel. The print area (ink ejection range), that is, the print starting position and the print ending position are determined on the basis of the result of the image development process. The move starting position FirstLineST is determined to be a forward position by a runway distance required for print starting position, and the stop position FirstLineEND is determined to be a position shifted by a required decelerating distance in the progressing direction. This determination is performed by the CPU 53 performing a higher-level program for directing the sequence control process, and a direction for performing a print operation of the sequence control is made by the CPU 53 with the move starting position FirstLineST and the stop position FirstLineEND designated. Accordingly, data for the move starting position FirstLineST and the stop position FirstLineEND used for the print processing routine as a part of the sequence control is given until a predetermined time before the front end position adjustment of the paper 38. In Step S34, the given data for FirstLineST and FirstLineEND is stored in a predetermined area of a memory (the RAM 56 or the nonvolatile memory 57).

When the printing operation for the second line and thereafter is performed, similarly, the image development is started in the paper transport process or at a timing earlier than the image development process. Data for the move starting position LastLineST and the stop position LastLineEND for the line to be printed is determined on the basis of the result of the image development. Then, the data for LastLineST and the stop position LastLineEND is given and a direction for performing a printing operation of the sequence control is made. In Step S35, the given data for the move starting position LastLineST and the stop position LastLineEND is stored in a predetermined area in a memory (the RAM 56 or the nonvolatile memory 57). In the memory, a predetermined area is arranged for storing the move starting position LastLineST and the stop position LastLineEND. The move starting position LastLineST and the stop position LastLineEND other than right after the paper feed are sequentially updated each time when a line is printed. Here, LastLineST and LastLineEND means the last line at a current time point for printing the current line. Accordingly, data for the move starting position LastLineST and the stop position LastLineEND at a time point of completing printing one copy represents the move starting position and the stop position for the last line.

In Step S36, the CR motor 33 is driven to move the carriage 32 from the given move starting position to the stop position for performing the print operation. The CPU 53 that performs a higher level program monitors the remaining paper feed amount (remaining number of steps) in the front end position adjustment process of the paper 38 and transmits a carriage driving direction to the sequence control side at a time when the remaining number of steps corresponding to a same time as required for moving from the move starting position of the carriage 32 to the print starting position. On the basis of the carriage driving direction, the driving of the CR motor 33 in Step S36 is started. Thus, the carriage operation may be performed partly in parallel with and in superposition with the front end position adjustment operation or the paper transport operation. As a result, when the front end position adjustment operation or the paper transport operation is completed, almost immediately the carriage 32 reaches the print staring position so as to start ink droplet ejection (firing). The paper feed operation and the carriage operation may be controlled to be alternately performed without superposing the paper feed operation and the carriage operation. In such a case, the driving of the CR motor 33 is started after the completion of the front end position adjustment operation of the paper 38 or the completion of the paper transport operation.

Here, when the first line of the first copy (first page) is printed, the carriage 32 waits in the set waiting position LineSTPos, and the move starting position FirstLineST is determined during the waiting process. At this moment, when a runway distance required between the set waiting position LineSTPos and the print starting position is not acquired, the CPU 53 performs a seek process and directs the carriage to return to the move starting position. As a result, the CR motor 33 is driven to rotate in a forward direction, and the carriage 32 returns to the trigger position that is in a direction opposite to the direction for progressing, and starts moving from the move starting position FirstLineST. However, when the carriage waits in the set waiting position LineSTPos, the returning seek operation is not required with a high probability.

In the print processing routine, when the carriage 32 reaches the print ending position in a one pass moving process for printing the first line, the deceleration of the CR motor 33 is started, and the carriage 32 is stopped in the stop position FirstLineEND. In this process, when the carriage 32 reaches the print ending position, a paper transport routine, not shown in the figure, which is a part of the sequence control process is performed, and the PF motor 42 is driven corresponding to the number of a predetermined paper transport steps, and thereby the paper 38 is transported. In this way, the print processing routine and the paper transport routine are alternately performed with partly superposition with each other, and thereby printing operations for each line is sequentially performed. As described above, when the whole lines for the first copy (first page) are printed, a paper discharge command is given, and as a result, the CPU 53 performs the paper discharge processing routine shown in FIG. 13.

When the paper discharge processing routine is started, first in Step S41, it is determined whether copy printing is performed. When the copy printing is performed, it is determined whether the designated number of copies≠0 (Step S42). When the designated number of copies≠0, it is determined whether the carriage is in the trigger allowance area (Step S43). When the carriage is determined to be in the trigger allowance area, it is determined that the print moving direction of the carriage is the trigger direction (a direction to be toward the trigger position) (Step S44). The determination described above is performed in the deceleration process of the carriage 32. When the print moving direction of the carriage is determined to be the trigger direction, the stop position of the carriage 32 extends to the trigger position TriggerPos. As a result, the carriage 32 passes through the stop position LastLineEND, is moved to the trigger position TriggerPos to be stopped. However, the carriage 32 may be stopped temporally in the stop position LastLineEND and then, moved to the trigger position TriggerPos. Next in Step S46, the stop position LastLineEND of the last line stored in the memory is rewritten in the trigger position TriggerPos.

On the other hand, when the designated number of copies for the final copy (final page)=0 (S42: NO), the carriage is not in the trigger allowance area (S43: NO), or the print moving direction of the carriage 32 is not the trigger direction (S44: NO), in Step S47, the PF motor 42 is driven corresponding to the number of paper discharge steps. Next in Step S48, it is determined whether the state of the paper detector 49 is "NO PAPER" that is a state no paper is detected. When the state of the paper detector is not "NO PAPER", in Step S49, it is determined whether the driving is completed. Then, when the state of the paper detector 49 is switched into "NO PAPER" before the driving is completed, the PF motor 42 is driven in correspondence with the number of steps of discharge, and thereby the paper 38 is completely discharged. On the other hand, when the driving operation is completed without switching the state of the paper detector 49 into "NO PAPER", the state is processed as a paper jam error.

For example, when the print operation for the last line of the first copy (first page) is completed and a paper discharge command is given, when the position paper is in the trigger allowance area TA and the carriage moving direction is the trigger direction, if the state of the paper detector 49 is switched into "NO PAPER" in accordance with the paper discharge operation thereafter, the paper feed processing routine shown in FIG. 10 is started again.

Then, in the paper feed processing routine, in Step S1, the carriage 32 is not in the trigger position TriggerPos (S1: NO), and accordingly, the CR motor 33 is driven so as to move the carriage 32 to the trigger position TriggerPos. As a result, the carriage 32 is moved to the trigger position, and the state of the clutch section 44 is switched into a connection state. By the change in the state of the clutch section 44, the paper feed driving routine shown in FIG. 11 is started so as to performed the paper feed operation and the front end position adjustment operation for the paper 38 are performed.

In the paper feed processing routine, for the copy printing for the second copy (second page) and thereafter, it is determined that the copy printing is performed in Step S3. Next in Step S4, the designated number of copies is calculated by using an equation of "designated number of copies=designated number of copies −1".

In Step S5, k, l, m, and n are calculated by using equations of "k=FirstLineST−FirstLineEND", "l=LastLineST−LastLineEND", "m=TriggerPos−FirstLineST", and "n=TriggerPos−LastLineEND". At this moment, FirstLineST, FirstLineEND, LastLineST, and LastLineEND are calculated by reading data for the move starting position of the first line, the stop position of the first line, the move starting position of the last line, the stop position of the last line stored in the memory in the print process for the previous copy (previous page). Accordingly, when the paper feed operation for the second copy is performed, data stored in the memory in the print process for the first copy is read for calculation.

In the paper feed process for the second copy, in Step S6, the value of the move starting position FirstLineST of the first line is determined not to be the initial value (FirstLineST=FFFF). Accordingly, the process proceeds to Step S7.

In Step S7, it is determined whether the designated number of copies≠0, that is, the print operation is performed for the final copy. For example, when a copy printing for five copies is performed, in the print process for the second copy, the value of the designated number of copies becomes three, and the designated number of copies≠0, and therefore the process proceeds to Step S8.

Next in Step S8, it is determined whether LastLineEND=TriggerPos. In other words, it is determined whether the stop position of the first line for the previous copy is the trigger position. When the condition of "LastLineEND=TriggerPos" is satisfied, the process proceeds to Step S13. On the other hand, when the condition is not satisfied, the process proceeds to Step S9. In other words, the condition that LastLineEND equals to TriggerPos indicates that the last line in the paper discharge processing routine (S44 and S46) for printing the previous copy is the trigger direction, and thus when the last line was the trigger direction, the process proceeds to Step S13. On the other hand, when the last line is not the trigger direction, the process proceeds to Step S9.

In Step S9, it is determined whether the last line is in the trigger allowance area. When the last line is in the trigger allowance area, the process proceeds to Step S10. On the other hand, when the last line is not in the trigger allowance area, the process proceeds to Step S13.

In Step S10, it is determined whether k<0. When k<0, the process proceeds to Step S13. On the other hand, when k<0 is not satisfied, the process proceeds to Step S11.

In Step S11, it is determined whether m<n. When it is determined that "m<n" is not satisfied, the process proceeds to Step S13. On the other hand, when it is determined that "m<n", the process proceeds to Step S14.

In other words, Steps S9, S10, and S11 correspond to a determination process whether the move starting position is replaced with FirstLineEND. When (1) the last line is in the trigger allowance area (S9), (2) "k<0" is not satisfied, that is, the moving direction of the carriage in the first line is a direction from the 80th column to the 1st column (trigger direction) (S10), and (3) m<n, that is a distance n from the stop position of the last line to the trigger position is longer than a distance m from the trigger position to the stop position of the first line, the process proceeds to Step S14. Next in Step S14, the carriage 32 is moved to the stop position of the first line.

On the other hand, when (1) LastLineEND is TriggerPos (S8: YES), (2) the last line is not in the trigger allowance area (S9: NO), (3) "k<0" is satisfied, that is, the moving direction of the carriage in the first line is a direction from the 1st column to the 80th column (counter-trigger direction), or (4) "m<n" is not satisfied, that is a distance n from the stop position of the last line to the trigger position is equal to or shorter than a distance m from the trigger position to the stop position of the first line, the process proceeds to Step S13.

Figure 9A:
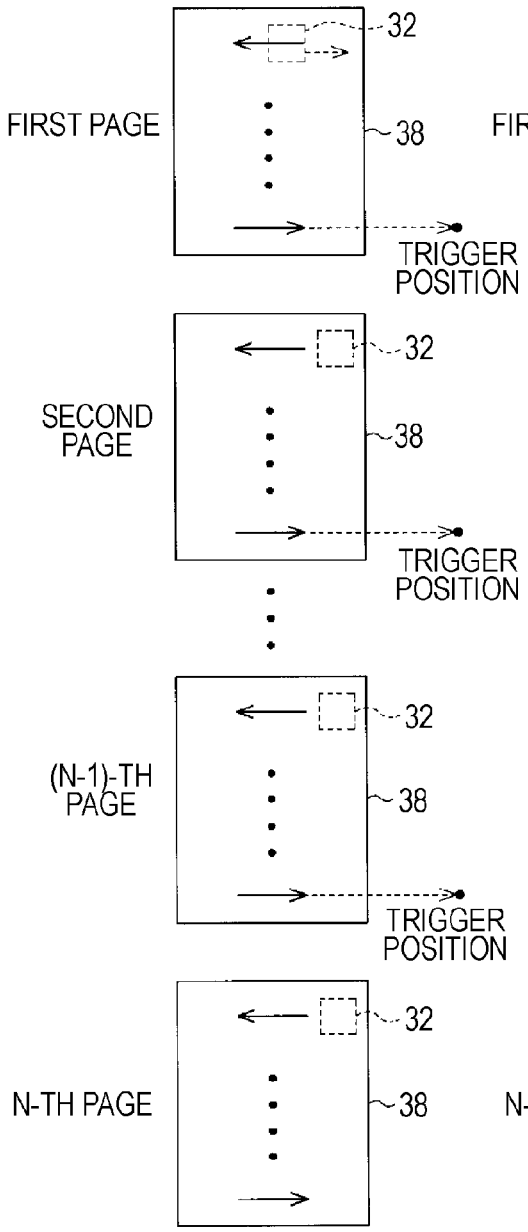
FIG. 9A is a diagram showing a copy printing operation according to an embodiment of the invention in a case where moving direction for the last line is a trigger direction.

As described above, as shown in FIG. 9A, when a print operation for a plurality of copies are performed, the carriage is moved from the trigger position to the move starting position (set waiting position LineSTPos) of the first line and is moved in the counter-trigger direction, and thereby the print for the first line of the first copy is performed. At this moment, when the runway distance is insufficient, the carriage is moved back by a distance for acquiring the runway distance by performing a seek operation and the move for printing is started from the position. For the last line of the first copy, as shown in FIGS. 6 and 9A, when the carriage is in the trigger allowance area and the moving direction of the carriage is the trigger direction, the stop position FirstLineEND extends to the trigger position TriggerPos.

Then, when a first line for the second page or a succeeding page is printed, the carriage 32 is moved to the move starting position FirstLineST that is the same as that of the first line for the first copy. Accordingly, the runway distance in the printing the first line after the paper feed can be shortened, and thereby the print operation (ink droplet ejection) for the first line can be started sooner. For the printing of the last line for the N-th copy that is the final copy, the carriage is stopped in the stop position LastLineEND ahead of TriggerPos. Then, the carriage 32 returns to the home position.

Figure 9B:
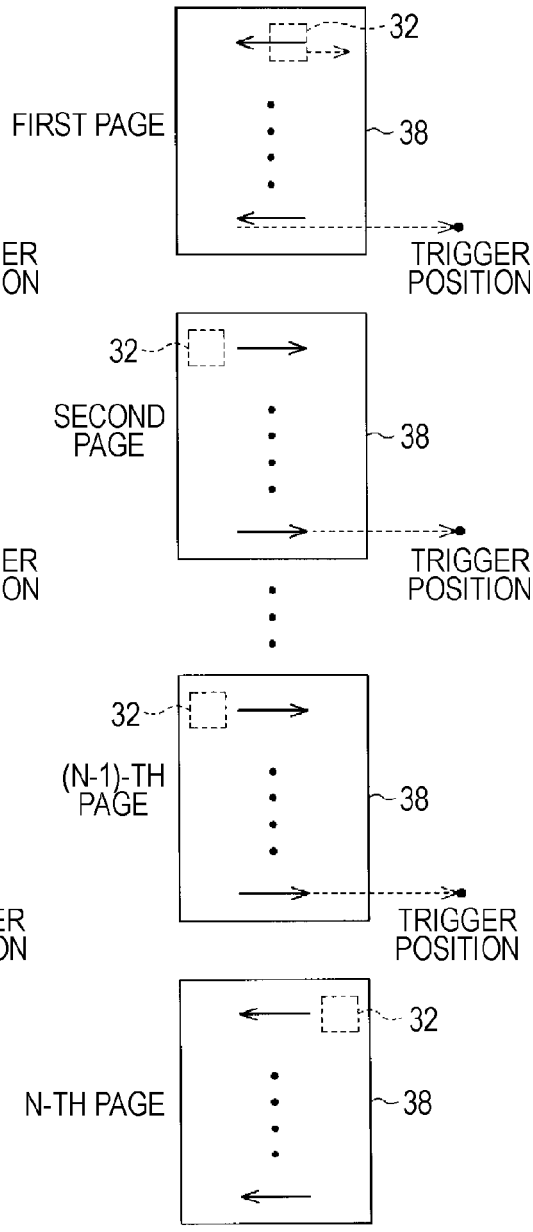
FIG. 9B is a diagram showing a copy printing operation according to an embodiment of the invention in a case where moving direction for the last line is a counter-trigger direction.

As shown in FIG. 9B, when a copy printing for a plurality of copies with the last line of the first page is in the counter-trigger direction, as shown in FIGS. 7 and 9B, first, when the last line of the first page is printed, the carriage 32 is stopped in the stop position FirstLineEND, and the carriage 32 is moved back in the trigger direction to the trigger position TriggerPos. Then, in the paper feed process thereafter, a first distance n required to move from the stop position of the last line LastLineEND to the trigger position TriggerPos and a second distance m required to move from the trigger position TriggerPos to the stop position of the first line FirstLineEND are compared to each other. When the first distance n is longer than the second distance (m<n), the move starting position of the first line is set to FirstLineEND. In other words, a first time required for the carriage 32 that has completed printing of the last line and stopped to move from the stop position LastLineEND to the trigger position TriggerPos for starting the next paper feed and a second time required for the carriage 32 that has started the next paper feed to move from the trigger position TriggerPos to the stop position of the first line are compared to each other, and a shorter time between the first time and the second time is selected. When the first time is shorter than the second time, the moving direction of the carriage for printing a first line of the second page and thereafter is set to be the trigger direction, and thereby the moving direction of the last column is set to be the trigger direction. In addition, in order to change the moving direction of the carriage for the first line to the opposite direction only for a case where a condition of "m<n" is satisfied, a case where the throughput is decreased by changing the moving direction of the carriage to the opposite direction can be prevented.

When the condition of "m<n" is replaced with the following condition, the moving direction of the carriage, which can improve the throughput more precisely, can be selected. The move starting position of the last line and the move starting position of the first line are considered. First, in a case where the moving direction of the carriage for printing is not changed to be the opposite direction, a first distance n1 from the stop position of the last line to the trigger position and a second distance m1 from the trigger position to the move starting position of the first line are summed together to be acquired as a first total moving distance p1. Next, in a case where the moving direction of the carriage for printing is changed to be the opposite direction, a first distance n2 from the stop position of the last line to the trigger position and a second distance m2 from the trigger position to the move starting position of the first line are summed together to be acquired as a second total moving distance p2. Then, a shorter one between the first total moving distance p1 and the second total moving distance p2 is selected. In other words, it is determined whether the first total moving distance p1 is longer than the second total moving distance p2 (p1>p2), and when the determination condition is satisfied, the moving direction of the carriage for the first line is changed to be an opposite direction. In other words, a total time calculated from summing a first time required for the carriage 32, which has completed the printing of the last line, to move to the trigger position for starting paper feed and a second time required for the carriage 32, which has started the paper feed, to move from the trigger position to the move starting position of the first line is compared for cases where the last line is set to be the counter-trigger direction (first time) and the moving direction of the carriage for the last line is changed to be the opposite direction (second time) so as to set the moving direction of carriage for the last line to be the trigger direction. Then, a moving direction of the carriage for which the required time is shorter is selected. In this case, it is preferable that the total time (or converted into a distance) is acquired, when the moving direction of the last line is set to be the trigger direction, considering that the carriage 32 can be moved to the trigger position without being stopped after the printing operation for the last line is completed.

When the total time is shortened in a case where the moving direction of the carriage is reversed (when a condition p1>p2 is satisfied), as shown in FIGS. 8 and 9B, the moving direction of the carriage for the first line is set to be opposite to that for the first page. Accordingly, in the copy printing after the second page and thereafter (second page to (N−1)-th page), the moving direction of the carriage is set to be opposite to that for the first page.

However, since for the copy printing for the final page (N-th page), the carriage is not needed to be moved to the trigger position for paper feed, the carriage is moved back to the move starting position of the first line in which the moving direction of the carriage becomes the counter-trigger position, like for the first page. In other words, in Step S7 of FIG. 10, when the designate number of copies≠0, the process proceeds to Step S12, and it is determined whether k<0, that is, the moving direction of the carriage for the first line is the trigger direction. When the moving direction of the carriage for the first line is the trigger direction (k<0), the process proceeds to Step S14, and moves the carriage 32 to the stop position of the first line at that moment, that is, the move starting position of the first line for the first page. Accordingly, when the copy printing for the final page is performed, a time required for the carriage 32 to move from the trigger position to the move starting position FirstLineST of the first line can be shortened, and thereby the throughput can be improved.

On the other hand, when the copy printing for the final page is performed (designated number of copies≠0), if "k<0" is not satisfied (that is, the moving direction of the carriage for the first line is the counter-trigger direction), the process proceeds to Step S13, and the carriage 32 is moved to the move starting position FirstLineST of the first line. As described above, printing for the lines is performed such that for the final page, the moving direction of the carriage 32 is always to be the trigger direction.

As described above in detail, according to an embodiment of the invention, the following advantages can be acquired.

(1) An appropriate move starting position FirstLineST for which a runway distance required for a print starting position determined on the basis of the result of the image development of the first line of the first page can be acquired is set as a move starting position of a first line for copy printing the second page or one of the succeeding pages. Accordingly, a time required for the carriage 32 to move from the move starting position to the print starting position can be shortened, and thereby the throughput of the recording apparatus can be improved.

(2) The moving direction of the carriage for a first line of the second copy or one of the succeeding copies is reversed when the moving direction for the last line is a counter-trigger direction. Accordingly, a time required for the carriage 32 to move to the trigger position after completing printing of the last line can be shortened. Thus, feed of the next paper can be started early, and thereby the throughput of the recording apparatus can be improved.

(3) As a condition for setting the moving direction of the carriage 32 opposite to that for copy printing the first page, a condition that a first distance n is longer than the second distance m (m<n) is used, and it is possible to minimize a case where decrease in the throughput occurs.

(4) Especially, as a determination condition for setting the moving direction for copy printing a first line of the second copy or one of the succeeding copies to be opposite to the moving direction of the carriage for the first line of the first page, when the following determining process is used instead of the condition of m<n shown in Step S11, it is possible to improve the throughput further. First, in a case where the moving direction of the carriage for printing is not changed to be the opposite direction, a first distance n1 from the stop position of the last line to the trigger position and a second distance m1 from the trigger position to the move starting position of the first line are summed together to be acquired as a first total moving distance. Next, in a case where the moving direction of the carriage for printing is changed to be the opposite direction, a first distance n2 from the stop position of the last line to the trigger position and a second distance m2 from the trigger position to the move starting position of the first line are summed together to be acquired as a second total moving distance. Then, a shorter one between the first total moving distance and the second total moving distance is selected. In this case, in a case where the moving direction for the last line becomes the trigger direction, when the total moving distance is acquired by converting a time shortened by not decelerating or not stopping the trigger into a distance, considering that the carriage 32 that has completed the printing operation for the last line can be moved to the trigger position without being decelerated or stopped, appropriate moving direction of the carriage can be selected more precisely, and thereby the throughput can be improved further.

(5) Even when the moving direction of the carriage for the last line of the first page is the counter-trigger direction, if the moving direction of the carriage is set to be an opposite direction, for copy printing the final page (N-th page), the carriage is not needed to be moved to the trigger position for paper feed after completing the printing of the last line, and thus, the moving direction of the carriage for the first line is returned to be the same direction as that for the first line of the first page. Accordingly, a distance from the trigger position to the move starting position of the first line of the final page is shortened, and thus the print operation for the first line can be started early, and therefore the throughput can be improved.

The embodiment of the invention may be changed to have the following configuration, as long as the advantages of the invention can be acquired.

MODIFIED EXAMPLE 1

In the above-described embodiment, although a copy printing operation has been described as an example, the invention is not limited thereto. For example, a configuration in which a plurality of copies of a same content (same data) is printed is sufficient. In such a case, the present invention is not limited to a multi function device, and a printer having a print function may be used. In addition, a configuration in which the data to be printed is read from an external recording medium such as a memory card, or a configuration in which the data is acquired from a host computer 10 by communication may be used.

MODIFIED EXAMPLE 2

The invention may be applied to a case where one copy includes a plurality of pages. In such a case, storage areas for each page is arranged in the memory, so that the move starting positions and stop positions of a first line and a last line for each page of the plurality of sheets (plurality of pages) forming one copy can be stored. When printing the second copy or thereafter, values FirstLineST, FirstLineEND, LastLineST, and LastLineEND acquired at a time when a page corresponding to that of the previous copy is printed may be used so as to determine the move starting position of the first line of the corresponding page. Under such a configuration, even when the move starting positions FirstLineST of first lines of each page are different, for the second copy and thereafter, the first line of each page can be printed from an optimal move starting position.

MODIFIED EXAMPLE 3

In the above-described embodiment, for lines other than the first line, a seek operation is required. However, a configuration in which the move starting positions LineST and the stop positions LineEND of all the lines of the first copy may be stored in the memory like the first line, for printing a line of the second copy and thereafter, the move starting position of the corresponding line is read from the memory, and the carriage 32 is moved to the move starting position may be used. In such a case, for printing a part for which the moving direction of the carriage for the second copy and thereafter is set to be opposite to that of the first copy, the stop position LineEND of a corresponding line is read from the memory, the stop position is set as the move starting position, and the carriage 32 is moved to the move starting position. When the carriage 32 passes the print ending position, if the move starting position of the next line is located ahead of the moving direction, it is preferable that the carriage 32 is moved to the move starting position of the next line without being stopped. Under such as configuration, since the seek operation is not performed for all the lines, a time required for paper feed is shortened and a loss time due to the seek operation for printing each line can be reduced, and thereby the throughput can be improved further. In addition, instead of performing the above-described operation for all the lines, the operation may be performed for a plurality of lines other than the first line.

MODIFIED EXAMPLE 4

For recording the second line of the first copy and thereafter, although the carriage 32 has been described to be moved to the set waiting position, the invention is not limited thereto. For example, the carriage may be waited in an area other than the recordable area, and the move starting position of the first line of the first copy is stored as disclosed in JP-A-10-244726 and the carriage may be moved to the move starting position that is the same as that of the first line for the second line and thereafter. In such a case, for the second line of the second copy and thereafter, the move starting position that is the same as that of the first line of the first copy may be used.

MODIFIED EXAMPLE 5

While the moving direction of the carriage of the first line is set to be opposite in a case where the moving direction is not toward the trigger position, a method in which the move starting position of the first line of the second copy and thereafter is configured to be the move starting position of the first line of the first copy may not be used. For example, the carriage may be moved to the set waiting position or may be waited outside the recordable area for performing a seek operation.

MODIFIED EXAMPLE 6

In the above-described embodiment, although the move starting position and the stop position have been described to be stored as the position specifying information, the invention is not limited thereto. As the position specifying information, the print starting position and the print ending position may be stored. In such a case, a runway distance required for the values may be additionally stored. Other data may be used as long as the data can specify the move starting position further. For example, a regulation value between the print starting position and the move starting position, a distance or moving time from a reference position (for example, the origin point) to the move starting position may be used as the position specifying information.

MODIFIED EXAMPLE 7

In the above-described embodiment, as the determination condition, a distance is used. However, for example, a time required for moving the carriage 32 may be used for the determination in Step S10, S11, or S12.

MODIFIED EXAMPLE 8

In the above-described embodiment, although a bidirectional printing operation has been described to be performed, however, one directional printing may be performed.

MODIFIED EXAMPLE 9

In the above-described embodiment, although the move staring position is determined by summing the print starting position and the printable distance as a predetermined runway distance, however, the runway distance may have an appropriate value. For example, it is preferable that the runway distance has a value equal to or greater than the printable distance and allowing the move starting position located on the center side of the paper relative to a position shifted from both end positions of the maximum printable area by an outer printable distance in a case where a print range is narrower than the printable area.

MODIFIED EXAMPLE 10

In the above-described embodiment, the carriage 32 waits in the set position LineSTPos for printing the first line and a seek operation is performed in a case where the runway distance is insufficient. However, a configuration in which the carriage waits in a waiting position in which the backward seek operation is not needed may be used. For example, the carriage may be waited in the trigger position, or may be waited in a position closet to the trigger determined on the basis of the print condition (left or right margin or frame end positions on the left/right side for printing without a frame) at that time for acquiring a runway distance, regardless of the print starting position.

MODIFIED EXAMPLE 11

In the above-described embodiment, although the printer unit 14 of the multi function device is described as an ink jet printer, however, the recording type of the printer unit may be appropriately changed. For example, the print unit may be a dot impact type printer or the like.

Hereinafter, technical aspects acquired from the above-described embodiment and the modified examples are described.

(1) The above-described recording apparatus, wherein a case where a plurality of copies of same data is recorded is a case where a plurality of copies of one page is recorded.

(2) The above-described recording apparatus, wherein a case where a plurality of copies of same data is recorded is a case where a plurality of copies of plural pages is recorded.

(3) The above-described recording apparatus, wherein a case where a plurality of copies of same data is recorded is a case where a plurality of pages of plural recording parts for each copy is recorded, and wherein the memory unit stores the position specifying information of each first line in a case where a plurality of copies for the first copy is recorded.

(4) The above-described recording apparatus, wherein the paper feed unit has a clutch section for connecting the driving source of the transport unit and the paper feed unit that feeds the recording medium in a state that power can be transferred and an operation unit operated by the recording unit such that the clutch section is in a connection state in a case where the recording unit is moved to a predetermined position other than the recordable area on the moving path.

(5) The above-described recording apparatus, wherein a waiting position in which the recording unit waits before recording the first line of the first copy is set in the recordable area on the moving path of the recording unit, and wherein the control unit starts moving the recording unit from the waiting position, calculates an appropriate move starting position corresponding to the record starting position, and stores the position specifying information for specifying the move starting position in the memory unit, in a case where the recording operation from the record starting position can be performed by moving from the waiting position, and the control unit returns to an appropriate move starting position corresponding to the record starting position from the waiting position, starts moving the recording unit, and stores the position specifying information for specifying the appropriate move starting position in the memory unit, in a case where the recording operation from the record starting position cannot be performed due to an insufficient runway distance by moving from the waiting position.

(6) The above-described recording apparatus, wherein the control unit performs an image development process for each line and acquires the recording position information on the result of the image development process. In addition, it is preferable that the record position information includes the record starting position and the record ending position of the first line.

(7) The above-described recording apparatus, wherein the position specifying information is a move starting position determined by adding a predetermined runway distance to the record starting position used as the record position information.

What is claimed is:

1. A recording apparatus that performs a recording operation on a recording medium by alternately performing a transport operation and the recording operation, the recording apparatus comprising:

a transport unit that transports the recording medium; a moving unit that moves a recording unit;

a feed unit that feeds the recording medium;

a feed starting unit that starts feeding of the recording medium by using the feed unit by an operation performed by the recording unit that has moved to a predetermined position on a moving path of the recording unit outside a recordable area;

a control unit that controls the transport unit and the moving unit; and a determination unit that determines whether the moving direction of the recording unit for recording the last line of the first copy is toward the predetermined position in a case where a recording operation for a plurality of copies of the same data is performed, wherein the control unit controls the moving unit such that the moving direction of the recording unit for recording a first line of the second copy or one of the following copies is opposite to the moving direction of the recording unit for recording a first line of the first copy when the moving direction of the recording unit for recording the last line of the first copy is determined not to be toward the predetermined position, wherein the determination unit acquires a total distance required for the recording unit, which has completed recording the last line, to move to the predetermined position and to move from the predetermined position to the move starting position of the first line before and after the reversing the moving direction and determines whether the total distance in a case where the moving direction is reversed is shorter than that in a case where the moving direction is not reversed, when determining that the moving direction of the moving unit is not toward the predetermined position, and wherein the control unit sets the moving direction of the recording unit for recording the first line of the second copy or one of the succeeding copies to be opposite to that for recording the first line of the first copy when the determination condition of the determination unit is satisfied.

2. A recording apparatus that performs a recording operation on a recording medium by alternately performing a transport operation and the recording operation, the recording apparatus comprising:

a transport unit that transports the recording medium; a moving unit that moves a recording unit;

a feed unit that feeds the recording medium;

a feed starting unit that starts feeding of the recording medium by using the feed unit by an operation performed by the recording unit that has moved to a predetermined position on a moving path of the recording unit outside a recordable area a control unit that controls the transport unit and the moving unit;

a determination unit that determines whether the moving direction of the recording unit for recording the last line of the first copy is toward the predetermined position in a case where a recording operation for a plurality of copies of the same data is performed; and a memory unit that stores position specifying information for specifying a move starting position determined on the basis of recording position information, wherein the control unit controls the moving unit such that the moving direction of the recording unit for recording a first line of the second copy or one of the following copies is opposite to the moving direction of the recording unit for recording a first line of the first copy when the moving direction of the recording unit for recording the last line of the first copy is determined not to be toward the predetermined position, wherein the recording unit performs a recording operation on the basis of the recording position information of the first line data provided prior to recording the first line of the first copy, and wherein the control unit determines a move starting position of the recording unit for recording the first line on the basis of the position specifying information read from the memory unit before recording the first line of the second copy and one of the succeeding copies and controls the moving unit such that the recording unit, which has started feed of the succeeding recording medium after completion of recording the previous copy, is moved to the determined move starting position from the predetermined position.

3. The recording apparatus according to claim 2, wherein, in the memory unit, as the position specifying information, a first position specifying information that can specify a move starting position corresponding to the record starting position for recording the first line of the first copy and a second position specifying information for specifying a move starting position for recording from a direction in which a record ending position of the first line of the first copy becomes the record starting position are stored, and wherein the control unit moves the recording unit, which has completed a paper feed starting operation before start of recording the first line of the second copy or one of the succeeding copies, to a move starting position corresponding to the first position specifying information read from the memory unit when determining that the moving direction of the moving unit for recording the last line of the first copy is toward the predetermined position, and wherein the control unit moves the recording unit, which has completed a paper feed starting operation before start of recording the first line of the second copy or one of the succeeding copies, to a move starting position corresponding to the second position specifying information read from the memory unit when determining that the moving direction of the moving unit for recording the last line of the first copy is not toward the predetermined position.

4. The recording apparatus according to claim 2, wherein the memory unit stores the position specifying information for specifying a move starting position of each line determined on the basis of record position information of line data provided before recording lines of the first copy in each line, and wherein the control unit controls the moving unit such that the recording unit is moved to a move starting position corresponding to the position specifying information of each line read from the memory unit at a time when the each line of the second copy and one of the succeeding copies is recorded.

5. A recording method for a recording apparatus that performs a recording operation on a recording medium by alternately performing a transport operation and the recording operation and has a transport unit that transports the recording medium, a moving unit that moves a recording unit for recording on the recording medium, a feed unit that feeds the recording medium, a memory unit that stores position specifying information for specifying a move starting position determined on the basis of recording position information, and a feed starting unit that starts feeding of the recording medium by using the feed unit by an operation performed by the recording unit that has moved to a predetermined position on a moving path of the recording unit outside a recordable area, the recording method comprising:

performing a recording operation in both directions for forward and returning movements of the recording unit and determining whether the moving direction of the recording unit for recording the last line of the first copy is toward the predetermined position in a case where a recording operation for a plurality of copies of the same data is performed; and controlling the moving unit such that the moving direction of the recording unit for recording a first line of the second copy or one of the following copies is opposite to the moving direction of the recording unit for recording a first line of the first copy when the moving direction of the recording unit for recording the last line of the first copy is determined not to be toward the predetermined position, wherein the recording operation is performed on the basis of the recording position information of the first line data provided prior to recording the first line of the first copy, and wherein controlling the moving unit also includes determining a move starting position of the recording unit for recording the first line on the basis of the position specifying information read from the memory unit before recording the first line of the second copy and one of the succeeding copies and controls the moving unit such that the recording unit, which has started feed of the succeeding recording medium after completion of recording the previous copy, is moved to the determined move starting position from the predetermined position.

* * * * *